US011628439B2

(12) United States Patent
Xia et al.

(10) Patent No.: US 11,628,439 B2
(45) Date of Patent: Apr. 18, 2023

(54) SINGLE-SHEATH MICROFLUIDIC CHIP

(71) Applicant: ABS Global, Inc., DeForest, WI (US)

(72) Inventors: Zheng Xia, DeForest, WI (US); Gopakumar Kamalakshakurup, DeForest, WI (US)

(73) Assignee: ABS GLOBAL, INC., Deforest, WI (US)

( * ) Notice: Subject to any disclaimer, the term of this patent is extended or adjusted under 35 U.S.C. 154(b) by 0 days.

(21) Appl. No.: 16/741,608

(22) Filed: Jan. 13, 2020

(65) Prior Publication Data

US 2021/0213452 A1 Jul. 15, 2021

(51) Int. Cl.
*B01L 3/00* (2006.01)

(52) U.S. Cl.
CPC ... *B01L 3/502776* (2013.01); *B01L 3/502761* (2013.01); *B01L 2200/0636* (2013.01); *B01L 2200/0647* (2013.01); *B01L 2300/06* (2013.01); *B01L 2300/0627* (2013.01); *B01L 2300/0819* (2013.01); *B01L 2300/0851* (2013.01); *B01L 2300/0858* (2013.01)

(58) Field of Classification Search
None
See application file for complete search history.

(56) References Cited

U.S. PATENT DOCUMENTS 3,390,449 A 7/1968 Fox
3,649,829 A 3/1972 Randolph
3,661,460 A 5/1972 Elking et al.
3,710,933 A 1/1973 Fulwyler et al.
3,764,901 A 10/1973 Kachel
3,791,517 A 2/1974 Friedman
4,175,662 A 11/1979 Zold
4,325,706 A 4/1982 Gershman et al.
4,395,397 A 7/1983 Shapiro
4,409,106 A 10/1983 Furuta et al.
(Continued)

FOREIGN PATENT DOCUMENTS

CA 1341328 C 12/2001
CN 2125369 U 12/1992
(Continued)

OTHER PUBLICATIONS

Trial Transcript, Sep. 5, 2019 (a.m.); *ABS Global, Inc.* v. *Inguran, LLC d/b/a Sexing Technologies*, Case Nos. 17-cv-446 and 14-cv-503, United States District Court for the Western District of Wisconsin.

(Continued)

*Primary Examiner* — Matthew D Krcha
(74) *Attorney, Agent, or Firm* — Nguyen Tarbet LLC

(57) ABSTRACT

Microfluidic devices and methods for focusing components in a fluid sample are described herein. The microfluidic devices feature a microfluidic chip having a micro-channel having a constricting portion that narrows in width, and a flow focusing region downstream of the micro-channel. The flow focusing region includes a positively sloping bottom surface that reduces a height of the flow focusing region and sidewalls that taper to reduce a width of the flow focusing region, thereby geometrically constricting the flow focusing region. The devices and methods can be utilized in sex-sorting of sperm cells to improve performance and increase eligibility.

20 Claims, 6 Drawing Sheets

(56) References Cited

U.S. PATENT DOCUMENTS 4,424,132 A 1/1984 Iriguchi
4,660,971 A 4/1987 Sage et al.
4,667,830 A 5/1987 Nozaki, Jr. et al.
4,765,737 A 8/1988 Harris et al.
4,885,473 A 12/1989 Shofner et al.
4,919,817 A 4/1990 Schoendorfer et al.
4,983,038 A 1/1991 Ohki et al.
5,007,732 A 4/1991 Ohki et al.
5,030,002 A 7/1991 North, Jr.
5,100,627 A 3/1992 Buican et al.
5,125,749 A 6/1992 Leugers et al.
5,135,759 A 8/1992 Johnson
5,180,065 A 1/1993 Touge et al.
5,194,909 A 3/1993 Tycko
5,229,297 A 7/1993 Schnipelsky et al.
5,483,469 A 1/1996 Van den engh et al.
5,491,550 A 2/1996 Dabbs
5,620,857 A 4/1997 Weetall et al.
5,674,743 A 10/1997 Ulmer
5,689,109 A 11/1997 Schultze
5,752,606 A 5/1998 Wilson et al.
5,800,690 A 9/1998 Chow et al.
5,837,115 A 11/1998 Austin et al.
5,849,178 A 12/1998 Holm et al.
5,858,187 A 1/1999 Ramsey et al.
5,879,625 A 3/1999 Rosianiec et al.
5,966,457 A 10/1999 Lemelson
5,985,216 A 11/1999 Rens et al.
6,008,010 A 12/1999 Greenberger et al.
6,053,856 A 4/2000 Hlavinka
6,071,442 A 6/2000 Dean et al.
6,146,897 A 11/2000 Cohenford et al.
6,159,739 A 12/2000 Weigl et al.
6,159,749 A 12/2000 Yagang et al.
6,171,865 B1 1/2001 Weigl et al.
6,185,664 B1 2/2001 Jeddeloh
6,213,151 B1 4/2001 Jacobson et al.
H1960 H 6/2001 Conrad et al.
6,368,871 B1 4/2002 Christel et al.
6,416,190 B1 7/2002 Grier et al.
6,416,959 B1 7/2002 Giuliano et al.
6,432,630 B1 8/2002 Blankenstein
6,451,264 B1 9/2002 Bhullar et al.
6,494,230 B2 12/2002 Chow
6,506,609 B1 1/2003 Wada
6,519,032 B1 2/2003 Kuebler et al.
6,519,954 B1 2/2003 Prien et al.
6,524,860 B1 2/2003 Seidel et al.
6,540,895 B1 4/2003 Spence et al.
6,549,275 B1 4/2003 Cabuz et al.
6,592,821 B1 7/2003 Wada et al.
6,637,463 B1 10/2003 Lei et al.
6,674,525 B2 1/2004 Bardell et al.
6,727,451 B1 4/2004 Fuhr et al.
6,808,075 B2 10/2004 Böhm et al.
6,833,542 B2 12/2004 Wang et al.
6,838,056 B2 1/2005 Foster
6,841,388 B2 1/2005 Dukor et al.
6,853,654 B2 2/2005 Mcdonald et al.
6,877,528 B2 4/2005 Gilbert et al.
6,944,324 B2 9/2005 Tran et al.
6,976,590 B2 12/2005 Deshpande et al.
7,029,430 B2 4/2006 Hlavinka et al.
7,069,943 B2 7/2006 Gilbert et al.
7,092,154 B2 8/2006 Yasuda et al.
7,104,405 B2 9/2006 Böhm et al.
7,195,920 B2 3/2007 Seidel et al.
7,208,265 B1 4/2007 Schenk
7,241,988 B2 7/2007 Gruber et al.
7,276,701 B2 10/2007 Lendl
7,298,478 B2 11/2007 Gilbert et al.
7,300,803 B2 11/2007 Lin et al.
7,311,476 B2 12/2007 Gilbert et al.
7,312,085 B2 12/2007 Chou et al.
7,355,696 B2 4/2008 Mueth et al.
7,355,699 B2 4/2008 Gilbert et al.
7,466,734 B1 12/2008 Day et al.
7,472,794 B2 1/2009 Oakey et al.
7,482,577 B2 1/2009 Gruber et al.
7,492,522 B2 2/2009 Gilbert et al.
7,524,681 B2 4/2009 Wolf et al.
7,569,788 B2 8/2009 Deshpande et al.
7,576,861 B2 8/2009 Gilbert et al.
7,584,857 B2 9/2009 Böhm et al.
7,611,309 B2 11/2009 Gilbert et al.
7,670,471 B2 3/2010 Quake et al.
7,697,576 B2 4/2010 Maier et al.
7,760,351 B2 7/2010 Cox et al.
7,820,425 B2 10/2010 Schenk
7,826,509 B2 11/2010 Belkin et al.
7,956,328 B2 6/2011 Sundaram et al.
7,963,399 B2 6/2011 Böhm et al.
7,997,831 B2 8/2011 Gilbert et al.
8,032,200 B2 10/2011 Tearney et al.
8,080,422 B2 12/2011 Neas et al.
8,123,044 B2 2/2012 Johnson et al.
8,149,402 B2 4/2012 Rich
8,158,122 B2 4/2012 Hampson et al.
8,173,001 B2 5/2012 Quake et al.
8,174,394 B2 5/2012 Ridder et al.
8,198,092 B2 6/2012 Durack et al.
8,206,987 B2 6/2012 Durack et al.
8,209,987 B2 7/2012 Hautman et al.
8,210,209 B2 7/2012 Gilbert et al.
8,277,764 B2 10/2012 Gilbert et al.
8,388,822 B2 3/2013 Quake et al.
8,408,399 B2 4/2013 Böhm et al.
8,502,148 B2 8/2013 Wagner et al.
8,529,161 B2 9/2013 Gilbert et al.
8,563,325 B1 10/2013 Bartsch et al.
8,567,608 B2 10/2013 Deshpande et al.
8,569,069 B2 10/2013 Durack
8,623,295 B2 1/2014 Gilbert et al.
8,727,131 B2 5/2014 Deshpande et al.
8,731,860 B2 5/2014 Charles et al.
8,863,962 B2 10/2014 Johnson et al.
8,941,062 B2 1/2015 Wagner et al.
8,961,904 B2 2/2015 Xia et al.
8,964,184 B2 2/2015 Gilbert et al.
8,981,298 B2 3/2015 Wagner et al.
9,000,357 B2 4/2015 Mueth et al.
9,003,869 B2 4/2015 Wagner et al.
9,011,797 B2 4/2015 Gilbert et al.
9,109,195 B2 8/2015 Zimmermann et al.
9,140,690 B2 9/2015 Mueth et al.
9,255,874 B2 2/2016 Sharpe et al.
9,260,693 B2 2/2016 Johnson et al.
9,335,247 B2 5/2016 Sharpe et al.
9,335,295 B2 5/2016 Mueth et al.
9,339,850 B2 5/2016 Deshpande et al.
9,365,822 B2 6/2016 Seidel et al.
9,377,400 B2 6/2016 Wagner et al.
9,446,912 B2 9/2016 Gilbert et al.
9,485,984 B2 11/2016 Burbank et al.
9,550,215 B2 1/2017 Deshpande et al.
9,588,100 B2 3/2017 Appleyard et al.
9,618,442 B2 4/2017 Sharpe et al.
9,683,922 B2 6/2017 Wagner et al.
D791,338 S 7/2017 Morkos et al.
9,752,976 B2 9/2017 Gilbert et al.
9,781,918 B2 10/2017 Zimmermann et al.
9,802,767 B2 10/2017 Gilbert et al.
9,823,252 B2 11/2017 Gilbert et al.
9,835,552 B2 12/2017 Wagner
D815,754 S 4/2018 Morkos et al.
9,943,847 B2 4/2018 Gilbert et al.
9,964,968 B2 5/2018 Sharpe et al.
10,025,322 B2 7/2018 Lofstrom et al.
10,029,283 B2 7/2018 Deshpande et al.
10,175,159 B2 1/2019 Wagner et al.
10,180,388 B2 1/2019 Wagner
10,216,144 B2 2/2019 Mueth et al.
10,315,194 B2 * 6/2019 Akiyama ..... G01N 15/1484
11,187,224 B2 11/2021 Xia et al.

(56) References Cited

U.S. PATENT DOCUMENTS 1,119,387 A1 12/2021 Wagner et al.
11,243,494 B2 2/2022 Mueth et al.
2002/0027649 A1 3/2002 Chudner
2002/0042042 A1 4/2002 Fahy
2002/0058332 A1 5/2002 Quake et al.
2002/0106716 A1 8/2002 Leboeuf et al.
2002/0115208 A1 8/2002 Mitchell et al.
2002/0176069 A1 11/2002 Hansen et al.
2002/0198928 A1 12/2002 Bukshpan et al.
2003/0007894 A1 1/2003 Wang et al.
2003/0032204 A1 2/2003 Walt et al.
2003/0047676 A1 3/2003 Grier et al.
2003/0054365 A1 3/2003 Xu et al.
2003/0054558 A1 3/2003 Kurabayashi et al.
2003/0068646 A1 4/2003 Singh et al.
2003/0113709 A1 6/2003 Alivisatos et al.
2003/0175944 A1 9/2003 Yang et al.
2003/0175980 A1 9/2003 Hayenga et al.
2003/0186426 A1 10/2003 Brewer et al.
2004/0043506 A1 3/2004 Haussecker et al.
2004/0079893 A1 4/2004 Dietz et al.
2004/0089798 A1 5/2004 Gruber et al.
2004/0144648 A1 7/2004 Jacobson et al.
2004/0161772 A1 8/2004 Bohm et al.
2004/0166504 A1 8/2004 Rossier et al.
2004/0206399 A1 10/2004 Heller et al.
2004/0217297 A1 11/2004 Moses et al.
2004/0229349 A1 11/2004 Daridon
2004/0266022 A1 12/2004 Sundararajan et al.
2005/0037471 A1 2/2005 Liu et al.
2005/0061962 A1 3/2005 Mueth et al.
2005/0103690 A1 5/2005 Kawano et al.
2005/0112541 A1 5/2005 Durack et al.
2005/0121604 A1 6/2005 Mueth et al.
2005/0123450 A1 6/2005 Gilbert
2005/0124869 A1 6/2005 Hefti et al.
2005/0148085 A1 7/2005 Larsen
2005/0153354 A1 7/2005 Gilmanshin
2005/0190372 A1 9/2005 Dogariu
2005/0196876 A1 9/2005 Chan et al.
2005/0207940 A1 9/2005 Butler et al.
2005/0207943 A1 9/2005 Puzey
2006/0013270 A1 1/2006 Yumoto et al.
2006/0035273 A1 2/2006 Quake et al.
2006/0043301 A1 3/2006 Mantele et al.
2006/0058167 A1 3/2006 Regusa et al.
2006/0078888 A1 4/2006 Griffiths
2006/0105453 A1 5/2006 Brenan et al.
2006/0152707 A1 7/2006 Kanda
2006/0170912 A1 8/2006 Mueth et al.
2006/0252047 A1 11/2006 Ekstrom et al.
2006/0257089 A1 11/2006 Mueth et al.
2006/0263829 A1 11/2006 Evans et al.
2007/0009386 A1 1/2007 Padmanabhan et al.
2007/0078348 A1 4/2007 Holman
2007/0114172 A1 5/2007 Mueth et al.
2007/0128082 A1 6/2007 Yang et al.
2007/0207551 A1 9/2007 Glensbjerg
2007/0247620 A1 10/2007 Koo
2007/0248958 A1 10/2007 Jovanovich et al.
2007/0255362 A1 11/2007 Levinson
2008/0003685 A1 1/2008 Goix et al.
2008/0014574 A1 1/2008 Viator et al.
2008/0069733 A1 3/2008 Maltezo et al.
2008/0144037 A1 6/2008 Mueth et al.
2008/0166188 A1 7/2008 Gilbert et al.
2008/0195020 A1 8/2008 Cabuz et al.
2008/0213821 A1 9/2008 Liu et al.
2008/0248966 A1 10/2008 Hansen et al.
2008/0261295 A1 10/2008 Butler et al.
2008/0292555 A1 11/2008 Ye et al.
2008/0299013 A1 12/2008 Trieu et al.
2008/0309919 A1 12/2008 Birmingham et al.
2008/0311005 A1 12/2008 Kim et al.
2009/0004652 A1 1/2009 Rubin et al.
2009/0029870 A1 1/2009 Ward et al.
2009/0032449 A1 2/2009 Mueth et al.
2009/0042241 A1 2/2009 Yu-Chong et al.
2009/0051912 A1 2/2009 Salazar et al.
2009/0114285 A1 5/2009 Hashimoto et al.
2009/0125242 A1 5/2009 Choi et al.
2009/0141279 A1 6/2009 Hillmer
2009/0156932 A1 6/2009 Zharov
2009/0170149 A1 7/2009 Viator et al.
2009/0176271 A1 7/2009 Durack et al.
2009/0201504 A1 8/2009 Ho et al.
2009/0225319 A1 9/2009 Lee et al.
2009/0281250 A1 11/2009 DeSimone et al.
2009/0290156 A1 11/2009 Popescu et al.
2010/0044570 A1 2/2010 McGill et al.
2010/0068723 A1 3/2010 Jovanovich et al.
2010/0079516 A1 4/2010 Nakazawa
2010/0171954 A1 7/2010 Quake et al.
2010/0216208 A1 8/2010 Mueth et al.
2010/0248362 A1 9/2010 Durack et al.
2010/0330693 A1 12/2010 Chapin et al.
2011/0001963 A1 1/2011 Durack
2011/0003303 A1 1/2011 Pagano et al.
2011/0003324 A1 1/2011 Durack
2011/0003325 A1 1/2011 Durack
2011/0003330 A1 1/2011 Durack
2011/0008764 A1 1/2011 Silva et al.
2011/0008767 A1 1/2011 Durack
2011/0008817 A1 1/2011 Durack
2011/0008818 A1 1/2011 Durack
2011/0075928 A1 3/2011 Jeong et al.
2011/0076712 A1 3/2011 Gilligan et al.
2011/0090500 A1 4/2011 Hu et al.
2011/0096327 A1 4/2011 Papautsky et al.
2011/0190146 A1 8/2011 Boehm et al.
2011/0223654 A1 9/2011 Holman et al.
2011/0256523 A1 10/2011 Mendele et al.
2011/0263747 A1 10/2011 Doyle et al.
2011/0294139 A1 12/2011 Takeda
2012/0009619 A1 1/2012 Gilbert et al.
2012/0028366 A1 2/2012 Krager et al.
2012/0033220 A1 2/2012 Kotidis et al.
2012/0033697 A1 2/2012 Goyal et al.
2012/0081709 A1 4/2012 Durack
2012/0082362 A1 4/2012 Diem et al.
2012/0107805 A1 5/2012 Neas et al.
2012/0122084 A1 5/2012 Wagner et al.
2012/0138152 A1 6/2012 Villarruel et al.
2012/0183947 A1 7/2012 Mueth et al.
2012/0196356 A1 8/2012 Wagner et al.
2012/0199741 A1 8/2012 Wagner et al.
2012/0199742 A1 8/2012 Wagner et al.
2012/0202237 A1 8/2012 Sedoglavich et al.
2012/0202277 A1 8/2012 Wagner et al.
2012/0202278 A1 8/2012 Wagner et al.
2012/0204628 A1 8/2012 Wagner et al.
2012/0225474 A1 9/2012 Wagner et al.
2012/0225475 A1 9/2012 Wagner et al.
2012/0273054 A1 11/2012 Lou et al.
2012/0287419 A1 11/2012 Sharpe et al.
2012/0295263 A1 11/2012 Cantor et al.
2012/0307244 A1 12/2012 Sharpe et al.
2013/0121877 A1 5/2013 Ono
2013/0164773 A1 6/2013 Bardell et al.
2013/0200277 A1 8/2013 Li et al.
2013/0224843 A1 8/2013 Evans et al.
2013/0252237 A1 9/2013 Wagner
2013/0295602 A1 11/2013 Fowler
2013/0313170 A1 11/2013 Bohm et al.
2014/0033808 A1 2/2014 Ding et al.
2014/0050540 A1 2/2014 Gilbert et al.
2014/0091014 A1 4/2014 Wagner et al.
2014/0224710 A1* 8/2014 Di Carlo ..... B01L 3/502761 209/132
2014/0273192 A1* 9/2014 Sharpe ..... G01N 15/1459 435/288.7
2014/0287243 A1 9/2014 Weber et al.
2014/0318645 A1 10/2014 Koksal
2014/0339446 A1 11/2014 Yamamoto et al.

(56) References Cited

U.S. PATENT DOCUMENTS

| | | | |
|---|---|---|---|
| 2014/0361148 | A1 | 12/2014 | Popescu et al. |
| 2015/0064694 | A1 | 3/2015 | Sadri |
| 2015/0114093 | A1* | 4/2015 | Appleyard ..... G01N 15/1404 73/61.59 |
| 2015/0192511 | A1 | 7/2015 | Wagner et al. |
| 2015/0198517 | A1 | 7/2015 | Simpson et al. |
| 2015/0276588 | A1 | 10/2015 | Marshall et al. |
| 2016/0004060 | A1 | 1/2016 | Simpson et al. |
| 2016/0123858 | A1 | 5/2016 | Kapur et al. |
| 2016/0199835 | A1* | 7/2016 | Tachibana ..... B01J 19/0093 435/303.2 |
| 2017/0016813 | A1 | 1/2017 | Wagner et al. |
| 2017/0181425 | A1 | 6/2017 | Burbank et al. |
| 2017/0333902 | A1 | 11/2017 | Masaeli et al. |
| 2018/0266937 | A1 | 9/2018 | De Wagenaar et al. |
| 2019/0025212 | A1 | 1/2019 | Evans |
| 2019/0040356 | A1 | 2/2019 | Durack et al. |
| 2019/0071725 | A1 | 3/2019 | Roti-Roti et al. |
| 2019/0160439 | A1* | 5/2019 | Muto ..... C22C 1/05 |
| 2019/0187044 | A1 | 6/2019 | Appleyard et al. |
| 2019/0390164 | A1 | 12/2019 | Morjal et al. |
| 2020/0070152 | A1* | 3/2020 | Kasai ..... G01N 15/1404 |
| 2022/0025443 | A1 | 1/2022 | Korani et al. |
| 2022/0026341 | A1 | 1/2022 | Appleyard et al. |

FOREIGN PATENT DOCUMENTS

| | | | |
|---|---|---|---|
| CN | 1482369 | | 3/2004 |
| CN | 1886315 | | 12/2006 |
| CN | 101189504 | | 5/2008 |
| CN | 109221081 | A | 1/2019 |
| CN | 109497040 | A | 3/2019 |
| CN | 109517787 | A | 3/2019 |
| EP | 0057907 | | 8/1982 |
| EP | 0282994 | | 9/1988 |
| EP | 0679325 | | 7/1994 |
| EP | 0471758 | A1 | 9/1996 |
| FR | 2798557 | | 3/2001 |
| GB | 502971 | | 5/1939 |
| GB | 2507959 | | 5/2014 |
| JP | 57-131451 | | 8/1982 |
| JP | 58090513 | | 5/1983 |
| JP | S 64-26125 | A | 1/1989 |
| JP | 64074451 | | 3/1989 |
| JP | 02105041 | | 4/1990 |
| JP | 03297385 | | 12/1991 |
| JP | H0526799 | | 2/1993 |
| JP | 06265452 | | 9/1994 |
| JP | 06327494 | | 11/1994 |
| JP | 07024309 | | 1/1995 |
| JP | 07286953 | | 10/1995 |
| JP | 2552582 | | 11/1996 |
| JP | H10512952 | | 12/1998 |
| JP | H11508182 | | 7/1999 |
| JP | 2000146819 | | 5/2000 |
| JP | 2000512541 | | 9/2000 |
| JP | 2001504936 | | 4/2001 |
| JP | 2002503334 | | 1/2002 |
| JP | 2002153260 | | 5/2002 |
| JP | 2003106980 | | 4/2003 |
| JP | 2003515738 | | 5/2003 |
| JP | 2004093553 | | 3/2004 |
| JP | 2005502482 | | 1/2005 |
| JP | 2005530986 | | 10/2005 |
| JP | 2006524054 | | 10/2006 |
| JP | 2007-514522 | A | 6/2007 |
| JP | 2007148981 | | 6/2007 |
| JP | 2007514522 | | 6/2007 |
| JP | 2007515936 | | 6/2007 |
| JP | 2008533440 | | 8/2008 |
| JP | 2008261295 | A1 | 10/2008 |
| JP | 2009085872 | A | 4/2009 |
| JP | 2009115672 | A | 5/2009 |
| JP | 2010117197 | | 5/2010 |
| JP | 2010151777 | | 7/2010 |
| JP | 2010190680 | | 9/2010 |
| JP | 2011145185 | | 7/2011 |
| JP | 2014503195 | | 2/2014 |
| WO | WO9622521 | | 7/1996 |
| WO | WO9700442 | | 1/1997 |
| WO | WO9739338 | | 10/1997 |
| WO | WO9747390 | | 12/1997 |
| WO | WO9810267 | | 3/1998 |
| WO | WO99/39223 | | 8/1999 |
| WO | WO20000070080 | A1 | 11/2000 |
| WO | WO0118400 | | 3/2001 |
| WO | WO0131315 | | 5/2001 |
| WO | WO2001040766 | | 6/2001 |
| WO | WO0185913 | | 11/2001 |
| WO | WO200241906 | | 5/2002 |
| WO | WO2002081183 | A1 | 10/2002 |
| WO | WO02087792 | | 11/2002 |
| WO | WO03024163 | | 3/2003 |
| WO | WO03062867 | | 7/2003 |
| WO | WO03078065 | A1 | 9/2003 |
| WO | WO2003078065 | | 9/2003 |
| WO | WO2004012133 | | 2/2004 |
| WO | WO2004029221 | | 4/2004 |
| WO | WO2004043506 | A1 | 5/2004 |
| WO | WO2004088283 | | 10/2004 |
| WO | WO20040088283 | A1 | 10/2004 |
| WO | WO2005023391 | | 3/2005 |
| WO | WO2005075629 | | 8/2005 |
| WO | WO20050075629 | A1 | 8/2005 |
| WO | WO2006119806 | | 11/2006 |
| WO | WO20060119806 | A1 | 11/2006 |
| WO | WO2007008495 | A2 | 1/2007 |
| WO | WO2007133710 | A2 | 11/2007 |
| WO | WO2008114458 | | 9/2008 |
| WO | WO2008126064 | A2 | 10/2008 |
| WO | WO2008130977 | A1 | 10/2008 |
| WO | WO2009032449 | A1 | 3/2009 |
| WO | WO2009134395 | | 11/2009 |
| WO | WO2010129441 | | 11/2010 |
| WO | WO2012068287 | A2 | 5/2012 |
| WO | WO2012112641 | | 8/2012 |
| WO | WO20120112641 | A1 | 8/2012 |
| WO | WO20130018273 | A1 | 2/2013 |
| WO | WO2013173446 | | 11/2013 |
| WO | WO2005037471 | A1 | 9/2014 |
| WO | 2015038494 | | 3/2015 |
| WO | WO2015063552 | | 5/2015 |
| WO | WO2018047011 | A2 | 3/2018 |
| WO | WO2018047011 | A2 | 5/2018 |
| WO | WO2018151680 | A1 | 8/2018 |
| WO | WO2020092321 | A1 | 5/2020 |
| WO | WO2020182193 | A1 | 9/2020 |

OTHER PUBLICATIONS

Brief in Support of ABS Global, Inc. and Genus PLC's Rule 50(8) Motion for Judgment as a Matter of Law and Rule 59 Motion for a New Trial, *ABS Global, Inc.* v. *Inguran, LLC d/b/a Sexing Technologies*, Case No. 14-cv-503, United States District Court for the Western District of Wisconsin. Filed Sep. 2, 2016.

Inguran, LLC and XY, LLC's Response To ABS Global, Inc. and Genus PLC's Rule 50(8) Motion Fof Judgment as a Matter of Law and Rule 59 Motion for New Trial, pp. 9-28, 33-36, 73-74. Filed Sep. 23, 2016.

ST's Response To ABS's Renewed Motion for Judgment as a Matter of Law That the Asserted Claims of The '987 Patent Are Invalid for Lack of Enablement And, in the Alternative, for a New Trial, *ABS Global, Inc.* v. *Inguran, LLC d/b/a Sexing Technologies*, Case No. 14-cv-503, United States District Court for the Western District of Wisconsin. Filed: Jul. 24, 2020.

"Clinical Laboratory Instruments and In Vitro Diagnostic Reagents", Personnel Department of the State Food and Drug Administration, et al., pp. 17-21, China Medical Science and Technology Publishing House, Oct. 31, 2010).

(56) References Cited

OTHER PUBLICATIONS

Dicarlo "Continuous inertial focusing, ordering, and separation of particles in microchannels" BioMEMS Resource Center, Center for Engineering in Medicine and Surgical Services, Massachusetts General Hospital, Nov. 27, 2007, PNAS, 18892-18897, vol. 104, No. 48.
Dicarlo "Equilibrium Separation and Filtration of Particles Using Differential Inertial Focusing" BioMEMS Resource Center, Center for Engineering in Medicine and Surgical Services, Massachusetts General Hospital, Anal Chem 2008, 8, 2204-2211.
Dicarlo "Inertial Microfluidics: High-Throughput Focusing and Separation of Cells and Particles" BioMEMS Resource Center, Center for Engineering in Medicine, Massachusetts General Hospital, Twelfth International Conference on Miniaturized Systems for Chemistry and Life Sciences, Oct. 12-16, 2008, San Diego, California, USA.
Sell, "Cellular Origin of Cancer: Dedifferentiation or Stem Cell Maturation Arrest?", Environmental Health Perspectives, vol. 101, Suppl. 5, 1993, p. 15-26.
Shapiro et al., "Pratical Flow Cytometry," Fourth Edition, New Jersey: John W. Wiley & Sons, 2003, 733 pages.
Sharpe et al.,"Advances in Flow Cytometry for Sperm Sexing," Theriogenology, vol. 71, 2009, pp. 4-10.
Short, "Raman Spectroscopy Detects Biochemical Changes Due to Proliferation in Mammalian Cell Cultures," Biophysical Journal, vol. 88, Jun. 2005, p. 427 4-4288.
USPTO, "Non-Final Office Action," issued in connection with U.S. Appl. No. 15/226/899, dated Apr. 12, 2018, 14 pages.
USPTO, "Notice of Allowance," issued in connection with U.S. Appl. No. 15/226/899, dated Aug. 23, 2018, 5 pages.
USPTO, "Notice of Allowance," issued in connection with U.S. Appl. No. 15/226/899, dated Sep. 20, 2018, 6 pages.
USPTO, "Final Office Action," issued in connection with U.S. Appl. No. 15/174,681, dated Jan. 2, 2018, 15 pages.
USPTO, "Final Office Action," issued in connection with U.S. Appl. No. 15/174,681, dated Sep. 14, 2018, 17 pages.
USPTO, "Non-Final Office Action," issued in connection with U.S. Appl. No. 15/174,681, dated May 4, 2017, 13 pages.
USPTO, "Non-Final Office Action," issued in connection with U.S. Appl. No. 15/174,681, dated Apr. 5, 2018, 16 pages.
USPTO, "Notice of Allowance," issued in connection with U.S. Appl. No. 15/174,681, dated Nov. 27, 2018, 10 pages.
USPTO, "Final Office Action," issued in connection with U.S. Appl. No. 13/298,148, dated Oct. 18, 2013, 46 pages.
USPTO, "Non-Final Office Action," issued in connection with U.S. Appl. No. 13/298,148, dated Feb. 5, 2013, 66 pages.
USPTO, "Notice of Allowance," issued in connection with U.S. Appl. No. 13/298,148, dated Sep. 19, 2014, 9 pages.
USPTO, "Office Action," issued in connection with U.S. Appl. No. 13/298,148, dated Sep. 28, 2012, 5 pages.
USPTO, "Final Office Action," issued in connection with U.S. Appl. No. 13/894,831, dated Sep. 10, 2015, 11 pages.
USPTO, "Final Office Action," issued in connection with U.S. Appl. No. 13/894,831, dated Jun. 15, 2017, 19 pages.
USPTO, "Non-Final Office Action," issued in connection with U.S. Appl. No. 13/894,831, dated Dec. 23, 2014, 11 pages.
USPTO, "Non-Final Office Action," issued in connection with U.S. Appl. No. 13/894,831, dated Oct. 5, 2016, 17 pages.
USPTO, "Notice of Allowance," issued in connection with U.S. Appl. No. 13/894,831, dated Apr. 1, 2016, 8 pages.
USPTO, "Notice of Allowance," issued in connection with U.S. Appl. No. 13/894,831, dated Sep. 5, 2017, 9 pages.
Wang et al., Detection of endogenous biomolecules in Barrett's esophagus by Fourier transform infrared spectroscopy, PNAS, vol. 104, No. 40, Oct. 2, 2007, p. 15864-15869.
Webster, Merriam, "Definition of "successive," Merriam Webster's Online Dictionary, accessed at http://www.merriamwebster.com/dictionary/successive," Jun. 18, 2013, 1 page.
Weida et al., "Quantum Cascade Laser Based Replacement for FTIR Microscopy," http://www.daylightsolutions. ::om/assets/003/5308.pdf, accessed online Aug. 2, 2012, 7 pages.
International Bureau, "International Preliminary Report on Patentability," issued in connection with International Patent Application No. PCT/IB2017/001289, dated Mar. 21, 2019, 12 pages.
International Search Report and Written Opinion for Application Serial No. PCT/IP2017/001289, dated Apr. 3, 2018, 21 pages.
Mehrnoush Malek et al.: flowDensity: reproducing manual gating of flow cytometry data by automated density-based cell population identification11 , BIOINFORMATICS., vol. 31, No. 4, Oct. 16, 2014 (Oct. 16, 2014), pp. 606-607.
International Search Report and Written Opinion for Application Serial No. PCT/IB2018/001641, dated Jun. 25, 2020 4 pages.
China Patent Office, "The Fourth Office Action," issued in connection with China Patent Application No. 201480071952.0, dated Jan. 3, 2021, 25 pages.
Japan Patent Office, "Notice of Reasons for Refusal," issued in connection with Japan Patent Application No. 2019-088655, dated Oct. 13, 2020, 5 pages.
Johnson LA et al., Flow sorting of X and Y chromosome-bearing spermatozoa into two populations, Gamete Research. Jan. 1987. 16(1):1-9. (Johnson 1987).
Paape et al., Flow Cytometry: A Versatile Tool for Studies On Cells From Domestic Animals, National Cytometry Symposium, Abstract Only, Dec. 14, 1997, https://www.ars.usda.gov/research/publications/publication/?seqNo115=86408.
Keij, J.F. et al., "High-Speed Photodamage Cell Selection Using a Frequency-Doubled Argon Ion Laser." Cytometry 19 (1995): 209-216. (Keij 1995).
Keij, J.F., "Introduction to High-Speed Flow Sorting." Flow and Image Cytometry. Series H: Cell Biology, 95 (1996): 213-227. (Keij 1996).
Johnson LA, Welch GR, Rens W. "The Beltsville sperm sexing technology: high-speed sperm sorting gives improved sperm output for in vitro fertilization and AI." J Anim Sci 1999. 77:213-220.
Counterclaim Defendants ABS Global Inc.'s and Genus PLC's Invalidity Contentions. *ABS Global, Inc*., v. *Inguran, LLC D/B/A Sexing Technologies* and. *XY, LLC* v. *Genus PLC*. Case No. 14-cv-503 United States District Court for the Western District of Wisconsin; pp. 1, 43-114, and 168-177.
ABS Global, Inc. And Genus PLC's Renewed Motion For Judgment As A Matter Of Law That The Asserted Claims Of The '987 Patent Are Invalid For Lack Of Enablement And, In The Alternative, For A New Trial. *ABS Global, Inc*. v. *Inguran, LLC & XY, LLC* v. *Genus PLC*. Case: 3:14-cv-00503-wmc. Filed on Jul. 3, 2020.
Brief in Support of ABS Global, Inc. And Genus PLC's Motion for Judgment as A Matter of Law That the Asserted Claims Of The '987 Patent Are Not Enabled. *Inguran, LLC d/b/a Stgenetics, XY, LLC, and Cytonome/ST, LLC*, Plaintiffs/Counterclaim-Defendants, v.*ABS Global, Inc., Genus PLC, and Premium Genetics (UK) Ltd*, Defendants/Counterclaim-Plaintiffs. Case: 3:17-cv-00446-wmc. Filed Sep. 6, 2019.
ABS Global, Inc. And Genus Plc Renewed Motion for Judgment As A Matter Of Law That The Asserted Claims Of The 987 Patent Are Invalid For Lack Of Enablement And, In The Alternative, For A New Trial. *Inguran, LLC d/b/a Stgenetics, XY, LLC, and Cytonome/ST, LLC*, Plaintiffs/Counterclaim-Defendants, v.*ABS Global, Inc., 3ENUS PLC, and Premium Genetics (UK) Ltd*, Defendants/Counterclaim-Plaintiffs. Case: 3:17-cv-00446-wmc. filed Jul. 3, 2020.
ABS Global, Inc. And Genus PLC's Reply In Support Of Their Renewed Motion For Judgment As A Matter Of Law That The Asserted Claims Of The '987 Patent Are Invalid For Lack Of Enablement And, In The Alternative, For A New Trial. *Inguran, LLC d/b/a Stgenetics, XY, LLC, and Cytonome/ST, LLC*, Plaintiffs/Counterclaim-Defendants, v. *ABS Global, Inc., Genus PLC, and Premium Genetics (UK) Ltd*, Defendants/Counterclaim-Plaintiffs. Case: :17-cv-00446-wmc. Filed Aug. 17, 2020.
ABS Global, Inc. and Genus PLC's Motion For Judgment As A Matter Of Law That The Asserted Claims Of The 987 And '092 Patents Are Invalid. *ABS Global, Inc*., Plaintiff/Counterclaim Defendant, v. *Inguran, LLC d/b/a Sexing Technologies*, Defendant/Counterclaim Plaintiff, and *XY, LLC*, Intervenor-Defendant/Counterclaim Plaintiff, v. *Genus PLC*, Counterclaim Defendant. Case: 3:14-cv-00503-wmc. Filed Aug. 9, 2016.

(56) References Cited

OTHER PUBLICATIONS

ABS Global, Inc. and Genus PLC's Rule 50(8) Motion For Judgment As A Matter Of Law And Rule 59 Motion For A New Trial. *ABS Global, Inc.*, Plaintiff/Counterclaim Defendant, v. *Inguran, LLC d/b/a Sexing Technologies*, Defendant/Counterclaim Plaintiff, and *XY, LLC*, Intervenor-Defendant/Counterclaim Plaintiff, v. *3ENUS PLC*, Counterclaim Defendant. Case: 3:14-cv-00503-wmc. Filed Sep. 2, 2016.
Opinion and Order of the United States District Court For The Western District Of Wisconsin. Plaintiff/Counterclaim Defendant, v. *Inguran, LLC d/b/a Sexing Technologies*, Defendant/Counterclaim Plaintiff, and *XY, LLC*, Intervenor-Defendant/Counterclaim Plaintiff, v. *Genus PLC*, Counterclaim Defendant Case: 3:14-cv-00503-wmc. riled Mar. 31, 2017.
Appeal from the United States District Court for the Western District of Wisconsin. No. 14-CV-503. *ABS Global, Nc.*, Plaintiff/Counterclaim Defendant-Appellant, and *Genus PLC*, Counterclaim Defendant-Appellant, v. *Inguran, LLC, doing business as Sexing Technologies*, Defendant/Counterclaim Plaintiff-Appellee, and *XY, LLC*, Intervening Defendant/Counterclaim Plaintiff-Appellee. Case: 3:14-cv-00503-wmc. Filed: Mar. 8, 2019.
Judge's Opinion & Order in Case No. 14-cv-503-wmc. Plaintiff/Counterclaim Defendant, v. *Inguran, LLC dib/a Sexing Technologies*, Defendant/Counterclaim Plaintiff, and *XY, LLC*, Intervenor-Defendant/Counterclaim Plaintiff, v. *Genus PLC*, Counterclaim Defendant. Case: 3:14-cv-00503-wmc. Filed Jul. 21, 2016.
ABS Global Inc. and Genus PLC's Reply in Support of Their Motion for Claim Construction and Partial Summary Judgment, *ABS Global, Inc.* v. *Inguran, LLC d/b/a Sexing Technologies*, Case No. 14-cv-503. United States District Court for the Western District of Wisconsin. Mar. 7, 2016.
Altendorf et al., "Results Obtained Using a Prototype Microfluidics-Based Hematology Analyzer," in Proceedings of the microTAS 1998 Symposium, 73-76 (Oct. 1998).
Nieuwenhuis et al., "Particle-Shape Sensing-Elements for Integrated Flow Cytometer," in Proceedings of the microTAS 2001 Symposium, 357-358 (Oct. 21, 2001).
Nieuwenhuis et al. "Virtual Flow Channel: A Novel Micro-fluidics System with Orthogonal, Dynamic Control of Sample Flow Dimensions," in Proceedings of the microTAS 2002 Symposium, vol. 1, 103-105 (Nov. 3, 2002).
Nieuwenhuis, J., et al. "Integrated flow-cells for novel adjustable sheath flows." Lab Chip, 2003, 3, 56-61 (Mar. 2003.
Shoji, S., et al. "Design and fabrication of micromachined chemical/biochemical systems." RIKEN Rev., vol. 36, pp. 8-11, 2001.
Lin, C., et al. "A Novel Microflow Cytometer with 3-dimensional Focusing Utilizing Dielectrophoretic and Hydrodynamic Forces." The Sixteenth Annual International Conference on Micro Electro Mechanical Systems, 2003. MEMS-03 Kyoto EEE, Kyoto, Japan, 2003, pp. 439-442.
Miyake et al., "A Development of Micro Sheath Flow Chamber," in Proceedings of the IEEE Micro Electro Mechanical Systems Workshop 1991, 265-270 (Jan. 1991).
Tashiro et al., "Design and Simulation of Particles and Biomolecules Handling Micro Flow Cells with Three-Dimensional Sheath Flow," in Proceedings of the microTAS 2000 Symposium, 209-212 (May 14, 2000).
Weigl, B. et al. "Design and Rapid Prototyping of Thin-Film Laminate-Based Microfluidic Devices." Biomedical Microdevices, 3:4, pp. 267-274, 2001.
Blankenstein, G. et al. "Modular concept of a laboratory on a chip for chemical and biochemical analysis." Biosensors & Bioelectronics, vol. 13. No 3-4, pp. 427-438, 1998.
Shapiro, Practical Flow Cytometry, 15-17, 133-135 (3rd ed. 1995).
Shapiro, Practical Flow Cytometry, 55-57, 166-169 (4th ed. 2003).
International Search Report for PCT Patent Application No. PCT/IB2014/001425 dated Apr. 28, 2015.
Herweijer, H. et al., "High Speed Photodamage Cell Selection Using Bromodeoxyuridine/Hoechst 33342 Photosensitized Cell Killing", Radiobiological Institute TNO, Rotterdam, The Netherlands, Jun. 1, 1987.
Johnson, L.A., et al., "Sex Preselection: High-Speed Flow Cytometric Sorting of X and Y Sperm for Maximum Efficiency" U.S. Dept. of Agriculture, Beltsville, MD, Sep. 23, 1999.
Bazyer H., et al., "Views and Reviews—Compact 151W Green Laser with U-Type Resonator for Prostate Surgery", Optics & Laser Technology, vol. 47, Apr. 27, 2013, 237-241.
Keij, J. et al., "High-Speed Photodamage Cell Sorting: An Evaluation of the ZAPPER Prototype", Methods in Cell Biology, 1994; pp. 371-386, vol. 42, Chapter 22, Academic Press, Inc.
International Search Report and Written Opinion dated Mar. 7, 2014 in connection with PCT/US2013/050669.
Kachel, V, et al., "Uniform Lateral Orientation, caused by Flow Forces, of Flat Particles in Flow-Through Systems", The Journal of Histochemistry and Cytochemistry, vol. 25, No. 7, pp. 774-780, 1977.
Notice of Allowance issued in U.S. Appl. No. 13/943,322 dated Sep. 12, 2014.
Fulwler, M., "Hydrodynamic Orientation of Cells", The Journal of Histochemistry and Cytochemistry, vol. 25, No. 7, pp. 781-783, 1977.
Khodjakov A., et al., "A Synergy of Technologies: Combining Laser Microsurgery with Green Fluorescent Protein fagging", Cell Motility and the Cytoskeleton 38:311-317 (1997), Division of Molecular Medicine and Department of Biomedical Sciences, Albany, New York.
Canadian Office Action, Application No. 2,929,275, dated May 4, 2020, 8 pages.
Australian Office Action, Application No. 2019202882, dated Mar. 26, 2020, 3 pages.
Brazilian Office Action, Application No. BR122017012966-0, dated Jun. 2, 2020, 6 pages.
Japan Patent Office, "Reconsideration Report by Examiner before Appeal," issued in connection with Japanese Patent Application No. 2016-551082, dated Jul. 12, 2019, 17 pages. 20090114285.
Intellectual Property India, "Examination Report," issued in connection with Indian Patent Application No. 3425/DELNP/2015, dated Jan. 20, 2020, 6 pages.
European Patent Office, "Extended European Search Report," issued in connection with patent application No. 19182993.6, dated Oct. 21, 2019, 11 pages.
China National Intellectual Property Administration, "Second Office Action," issued in connection with Chinese Patent Application No. 201480071952.0, dated Nov. 26, 2018, 34 pages.
China National Intellectual Property Administration, "Decision of Rejection," issued in connection with Chinese Patent Application No. 201480071952.0, dated Mar. 4, 2019, 19 pages.
IP Australia, "Examination Report No. 1 for Standard Patent Application," issued in connection with Australian Patent Application No. 2014343391, dated Sep. 4, 2018, 3 pages.
International Preliminary Report on Patentability, issued in connection with application PCT/IB/001425, dated May 3, 2016, 11 pages.
Japan Patent Office, "Non Final Notice of Reasons for Rejection," issued in connection with Japanese Patent Application No. 2016-551082, dated Apr. 24, 2018, 5 pages.
New Zealand IP Office, "First Examination Report," issued in connection with New Zealand Patent Application No. 720575, dated Sep. 9, 2016, 5 pages.
New Zealand IP Office, "Further Examination Report," issued in connection with New Zealand Patent Application No. 720575, dated Apr. 28, 2017, 3 pages.
State Intellectual Property Office of People'S Republic of China, "Notification of First Office Action," issued in connection with Chinese Patent Application No. 201480071952.0, dated Mar. 16, 2018, 31 pages.
New Zealand IP Office, "Further Examination Report," issued in connection with New Zealand Patent Application No. 735496, dated Aug. 31, 2018, 2 pages.

(56) References Cited

OTHER PUBLICATIONS

Drobnis et al., Cold Shock Damage is due to Lipid Phase Transitions in Cell Membranes: A Demonstration Using Sperm as a Model, The Journal of Experimental Zoology, 1993, 265:432-437.
Way et al., Comparison of four staining methods for evaluating acrosome status and viability of ejaculated and cauda epididymal bull spermatozoa, Theriogenology, 1995, 43(8): 1301-1316.
Marian et al., Hypo-osmotic Shock Induces an Osmolality-dependent Permeabilization and Structural Changes in the Membrane of Carp Sperm, 1993, 41(2):291-297.
Molecular Probes Inc., Product Information, Influx Pinocylic Cell-Loading Reagent (1-14402), Revised Feb. 1, 2001, 1-7.
Parks, Processing and Handling Bull Semen for Artificial Insemination—Don't Add Insult to Injury!, Department of Animal Sciences, Cornell University, 2001, retrieved on May 29, 2015, retrieved from the internet: http://www/ansci.cornell.edu/bullsemen.pdf.
Mammal (Online Datasheet), Wikipedia, 2003, retrieved on Aug. 13, 2018, retrieved from internet: http://web.archive.org/web/20031230110838/hllps://en.wikipedia.org/wiki/Mammal.
International Searching Authority, "International Search Report and Written Opinion," issued in connection with International Patent Application No. PCT/IB2016/000295, dated Oct. 14, 2016, 19 pages.
International Bureau, "International Preliminary Report on Patentability," issued in connection with International Patent Application No. PCT/IB2016/000295, dated Aug. 31, 2017, 14 pages.
Japan Patent Office, "Office Action," issued in connection with Japanese Patent Application No. 2017-543990, dated Jul. 31, 2019, 23 pages.
Di Carlo et al. "Equilibrium Separation and Filtration of Particles Using Differential Inertial Focusing" Anal. Chem. 2008, 30, 2204-2211 (Year: 2008).
"Hydraulic Diameter", Neutrium, Apr. 1, 2012, https://neutrium.net/fluid-flow/hydraulic-diameter/ (Year: 2012).
Gossett et al. "Particle Focusing Mechanisms in Curving Confined Flows" Anal. Chem. 2009, 81, 8459-8465 (Year 2009).
Di Carlo et al. "Continuous inertial focusing, ordering, and separation of particles in microchannels" PNAS Nov. 27, 2007 vol. 104 No. 48 18893 (Year: 2007).
Ai-Holy et al., "The Use of Fourier Transform Infrared Spectroscopy to Differentiate *Escherichia coli* 0157:H7 from Other Bacteria Inoculated Into Apple Juice," Food Microbiology, vol. 23, 2006, 162-168.
Alberts et al., "Molecular Biology of the Cell, 5th edition," New York: Garland Science, 2008, p. 1293.
Barcot et al., "Investigation of Spermatozoa and Seminal Plasma by Fourier Transform Infrared Spectroscopy," Applied Spectroscopy, vol. 61, No. 3, Mar. 2007, pp. 309-313.
Bassan et al.; "Reflection Contributions to the Dispersion Artefact in FTIR Spectra of Single Biological Cells," Analyst, vol. 134, Apr. 9, 2009, pp. 1171-1175.
Bassan et al.; "Resonant Mie Scattering in Infrared Spectrascopy of Biological Materials—Understanding the 'Dispersion Artefact'," Analyst, vol. 134, 2009, pp. 1586-1593.
Bassan et al.; "Resonant Mie Scattering {RMieS) Correction of Infrared Spectra From Highly Scattering Biological Samples," Analyst, vol. 135, No. 2, Feb. 2010, pp. 268-277.
Belkin et al.; "Intra-Cavity Absorption Spectroscopy with Narrow-Ridge Microfluidic Quantum Cascade Lasers,"Applies Express, vol. 15, No. 18, Sep. 3, 2007, pp. 11262-11271.
Boustany et al.; "Microscopic Imaging and Spectroscopy with Scattered Light," Annual Review of Biomedical Engineering, vol. 12, 2010, pp. 285-314.
Chan et al.; "Nondestructive Identification of Individual Leukemia Cells by Laser Trapping Raman Spectroscopy," Analytical Chemistry, vol. 80, No. 6, Mar. 15, 2008, 8 pages.
Chan et al.; "Label-Free Biochemical Characterization of Stem Cells Using Vibrational Spectroscopy," Journal of Biophotonics vol. 2, No. 11, Aug. 5, 2009, pp. 656-668.
Chan et al.; "Label-Free Separation of Human Embryonic Stem Cells {hESCs) and their Cardiac Derivatives using Raman Spectroscopy," Lawrence Livermore Journal, LLNL-JRNL-406938, Sep. 11, 2008, 30 pages.
Chen et al.; "Synctrotron Infrared Measurements of Protein Phosphorylation in Living Single PC12 Cells during Neuronal Differentiation," Analytical Chemistry, vol. 84, 2012, pp. 4118-4125.
Cheng et al., "Laser-Scanning Coherent Anti-Strokes Raman Scatteling Microscopy and Applications to Cell Biology," Biophysical Journal, vol. 83, Jul. 2002, pp. 502-509.
Cho et al., "Passively Driven Integrated Microfluidic System for Separation of Motile Sperm," Analytical Chemistry, vol. 75, Apr. 1, 2003, Abstract.
"Clinical Laboratory Instruments and In Vitro Diagnostic Reagents", Personnel Department of the State Food and Drug Administration, at al., pp. 17-21, China Medical Science and Technology Publishing House, Oct. 31, 2010.
Cho et al., "A Microfluidic Device For Separating Motile Sperm From Nonmotile Sperm Wa Inter-Streamline Crossings," 2nd Annual International IEEE-EMBS Special Topic Conference on Microtechnologies in Medicine and Biology. Proceedings (Cat. No. 02EX578) , Madison, WI, USA, 2002, pp. 156-159.
Cleary et al., "Infrared Surface Plasmon Resonance Biosensor," OSA Biomed, Miami, Florida, Apr. 2010, 6 pages.
Dousseau et al., "On the Spectral Subtraction of Water from the FT-IR Spectra of Aqueous Solutions of Proteins," Applied Spectroscopy, vol. 43, No. 3, 1989, pp. 538-542.
Downes et al., "Optical Spectroscopy for Noninvasive Monitoring of Stem Cell Differentation," Journal of Biomedicine and Biotechnology, vol. 2010, Article ID 101864, 2010, 10 pages.
Ege, "Organic Chemistry: Structure and Reactivity," Fifth Edition, Boston, MA, Houghton Mifflin Company, 2004, pp. 453-457.
European Patent Office, "Extended European Search Report," issued in connection with European Patent Application No. 11841869.8, dated Feb. 15, 2018, 9 pages.
Fu et al., "A Microfabricated Fluorescence-Activated Cell Sorter," Nature Biotechnology, vol. 17, Nov. 1999, pp. 1109-1111.
Green et al., "Flow Cytometric Determination of Size and Complex Refractive Index for Marine Particles: Comparison with Independent and Bulk Estimates," Applied Optics, vol. 42, No. 3, Jan. 20, 2003, pp. 526-541.
Harvey et al., "Discrimination of Prostate Cancer Cells by Reflection Mode FTIR Photoacoustic Spectroscopy," The Analyst, vol. 132, 2007, pp. 292-295.
Herzenberg et al., "Fluorescence-activated Cell Sorting," Scientific American, vol. 234, Mar. 1976, pp. 108-117.
Holman et al., "Synchrotron-Based FTIR Spectromicroscopy: Cytotoxicity and Heating Considerations," Journal of Biological Physics, vol. 29, 2003, pp. 275-286.
Holman et al., "IR Spectroscopic Characteristics of Cell Cycle and Cell Death Probed by Synchrotron Radiation Based Fourier Transform IR Spectromicroscopy," Biopolymers (Biospectroscopy) vol. 57, 2000, pp. 329-335.
Holman et al., "Tracking Chemical Changes in a Live Cell: Biomedical Applications of SR-FTIR Spectromicroscopy,"Lawrence Berkeley National Laboratory, http://escholarship.org/uc/item/9k185794, Berkeley, CA Jul. 25, 2002, 34 pages.
Huser et al., "Raman Spectroscopy of DNA Packaging in Individual Human Sperm Cells Distinguishes Normal From Abnormal Cells," Journal of Biophotonics, vol. 2, No. 5, 2009, pp. 322-332.
Intel, "Intel C-bank Tunable Laser, Performance and Design," White Paper, May 2003, 14 pages.
International Searching Authority, "International Search Report and Written Opinion," International Patent Application No. PCT/US2013/41123, dated Aug. 19, 2013, 12 pages.
International Search Authority, "International Preliminary Report on Patentability," International Patent Application No. PCT/US2011/061046, dated May 30, 2013, 7 pages.
International Searching Authority, "International Preliminary Report on Patentability," International Patent Application No. PCT/US2013/041123, dated Nov. 18, 2014, 7 pages.

(56) References Cited

OTHER PUBLICATIONS

Japan Patent Office, "Office Action," issued in connection with Japanese Patent Application No. 2013-539983, dated Jul. 8, 2015, 6 pages.
Japan Patent Office, "Office Action," issued in connection with Japanese Patent Application No. 2013-539983, dated Jul. 2, 2016, 6 pages.
Japan Patent Office, "Office Action," issued in connection with Japanese Patent Application No. 2016-198323, dated Oct. 2, 2017, 3 pages.
Japan Patent Office, "Office Action," issued in connection with Japanese Patent Application No. 2016-198323, dated Jul. 25, 2018, 9 pages.
Lee et al., "DFB Quantum Cascade Laser Arrays," IEEE Journal of Quantum Electronics, vol. 45, No. 5, May 9, pp. 554-565.
Ibbus et al., "Incidence of Chromosome Aberrations in Mammalian Sperm Stained with Hoechst 33342 and UV-aser Irradiated During Flow Sorting," Mutation Research, vol. 182, 1987, pp. 265-274.
Malone, Jr., "Infrared Microspectroscopy: A Study of the Single Isolated Bread Yeast Cell," Thesis, The Ohio State University, 2010, 162 pages.
Meister et al., "Confocal Raman Microspectroscopy as an Analytical Tool to Assess the Mitochondral Status in Human Spermatozoa," Analyst, vol. 135, 2010, pp. 1370-1374.
Miyamoto et al., "Label-free Detection and Classification of DNA by Surface Vibration Spectroscopy in Conjugation with Electrophoresis," Applied Physics Letters, vol. 86, No. 053902, 2005, 3 pages.
Mohlenhoff et al., "Mie-Type Scattering and Non-Beer-Lambert Absorption Behavior of Human Cells in Infared Microspectroscopy," Biophysical Journal, vol. 88, May 2005, pp. 3635-3640.
Montag et al., "Laser-induced Immobilization and Plasma Membrane Permeabilization in Human Spermatozoa," Human Reproduction, vol. 15, No. 4, 2000, pp. 846-852.
Mourant et al., "Methods for Measuring the Infrared Spectra of Biological Cells," Physics in Medicine and Biology, vol. 48, 2003, pp. 243-257.
Van Munster, "Interferometry in Flow to Sort Unstained X-and Y-Chromosome-Bearing Bull Spermatozoa,"Cytometry, vol. 47, 2002, pp. 192-199.
Rajagopalan et al., "Aneuploidy and Cancer," Nature, vol. 432, Nov. 2004, pp. 338-341.
Ropcke et al., "Application of Mid-Infrared Tuneable Diode Laser Absorption Spectroscopy to Plasma Diagnostics: A Review," Plasma Sources Science and Technology, vol. 15, 2006, S148-S168.
Schaden et al., "Quantum Cascade Laser Modulation for Correction of Matrix-Induced Background Changes in Aqueous Samples," Applied Physics B, vol. 86, 2007, pp. 347-351.
Sandt et al., "Identification of Spectral Modifications Occurring during Reprogramming of Somatic Cells," PLoS ONE, vol. 7, Issue 4, e30743, Apr. 2012, 7 pages.
Lin, C., et al. "A Novel Microflow Cytometer with 3-dimensional Focusing Utilizing Dielectrophoretic and Hydrodynamic Forces." The Sixteenth Annual International Conference on Micro Electro Mechanical Systems, 2003. MEMS-03 Kyoto, IEEE, Kyoto, Japan, 2003, pp. 439-442.
Jokinen, Ville, et al. "Durable superhydrophobicity in embossed CYTOP fluoropolymer micro and nanostructures". Colloids and Surfaces A: Physicochemical and Engineering Aspects, vol. 434, 2013, pp. 207-212.
Forsberg, Pontus, Fredrik Nikolajeff, and Mikael Karlsson, "Cassie-Wenzel and Wenzel-Cassie transitions on immersed superhydrophobic surfaces under hydrostatic pressure", Soft Matter, vol. 7, No. 1, 2011, pp. 104-109.
Lu, Hang, Martin A. Schmidt, and Klavs F. Jensen, "Photochemical reactions and on-line UV detection in microfabricated reactors", Lab on a Chip, vol. 1, No. 1, 2001, pp. 22-28.
Japan Patent Office, "Office Action," issued in connection with Japanese Patent Application No. 2019-513891, dated Jun. 24, 2021, 11 pages.
Brazilian Office Action, Application No. BR112019004727-1, dated Jul. 6, 2021, 4 pages.
Australian Office Action, Application No. 2017323502, dated Jun. 28, 2021, 6 pages.
China Office Action, Application No. 201780056064.5, dated Apr. 26, 2021, 8 pages.
China Office Action, Application No. 201780056064.5, dated Nov. 4, 2020 11 pages.
Europe Office Action, Application No. 17808998.3, dated Jul. 21, 2020.
Pedreira Carlos E et al: "Overview of clinical flow cytometry data analysis: recent advances and future challenges", Trends in Biotechnology, Elsevier Publications, Cambridge, GB, vol. 31, No. 7, Jun. 5, 2013.
China Patent Office, "The Third Office Action," issued in connection with China Patent Application No. 201480071952.0, dated Jul. 23, 2020, 23 pages.
Intellectual Property India, "Examination Report," issued in connection with Indian Patent Application No. 3429/DELNP/2015, dated Mar. 26, 2018, 6 pages.
European Patent Office, "European Search Report," issued in connection with patent application No. 20167363.9, dated Jul. 21, 2020, 9 pages.
Japan Patent Office, "Notice of Reasons for Refusal," issued in connection with Japan Patent Application No. 2018-220397, dated Aug. 5, 2020, 3 pages.
European Patent Office, "Examination Report," issued in connection with European Patent Application No. 16723498.8, dated Oct. 12, 2020, 6 pages.
European Patent Office, "European Search Report," issued in connection with European Patent Application No. 14168200.5, dated Mar. 20, 2015, 12 pages.
European Patent Office, "European Search Report," issued in connection with European Patent Application No. 17172322.4, dated Aug. 24, 2017, 8 pages.
European Patent Office, "European Search Report," issued in connection with European Patent Application No. 15160613.4, dated Jul. 24, 2015, 14 pages.
European Patent Office, "Communication pursuant to Article 94(3) EPC," issued in connection with European Patent Application No. 17172322.4, dated Aug. 14, 2018, 5 pages.
European Patent Office, "Communication pursuant to Article 94(3) EPC," issued in connection with European Patent Application No. 11193936.9, dated Dec. 11, 2015, 3 pages.
European Patent Office, "Communication pursuant to Article 94(3) EPC," issued in connection with European Patent Application No. 15160613.4, dated Jul. 11, 2016, 4 pages.
Hori et al., "Cell fusion by optical trapping with laser-involves contacting different cells with each other then imparting high voltage pulse to cells," WPI/Thompson, Dec. 27, 1991, Abstract, 1 page.
Japan Patent Office, "Notification of Reasons for Refusal," issued in connection with Japanese Patent Application No. 2016-185743, dated Jul. 3, 2018, 7 pages.
Japan Patent Office, "Final Notification of Reasons for Rejection," issued in connection with Japanese Patent Application No. 2011-256171, dated Oct. 28, 2014, 5 pages.
Japan Patent Office, "Decision for Grant," issued in connection with Japanese Patent Application No. 2015-091320, dated May 6, 2017, 7 pages.
Japan Patent Office, "Final Notification of Reasons for Rejection," issued in connection with Japanese Patent Application No. 2015-091320, dated Mar. 22, 2016, 22 pages.
Japan Patent Office, "Notification of Reasons for Refusal," issued in connection with Japanese Patent Application No. 2016-185743, dated Jul. 26, 2017, 2 pages.
Smith et al., "Inexpensive Optical Tweezers for Undergraduate Laboratories," Am. J. Phys., vol. 67, No. 1, Jan. 1999, 10 pages.
Takayama et al., "Patterning Cells and Their Environments Using Multiple Laminar Fluid Flows in Capillary Networks," Proceedings of National Academy of Sciences, vol. 96, 1999, 4 pages.
Ts'O, Basic Principles in Nucleic Acid Chemistry, National Library of Medicine, 1974, pp. 311-387.

(56) References Cited

OTHER PUBLICATIONS

Japan Patent Office; "Notice of Reasons for Refusal,"issued in connection with Japanese Patent Application No. 2019-088655, dated Feb. 18, 2020, 5 pages.
International Preliminary Report on Patentability corresponding to International Patent Application No. PCT/US2013/050669, dated Jan. 28, 2016, 15 pages.
Supplementary European Search Report for Application No. 13889551, dated May 22, 2017, 12 pages.
State Intellectual Property Office of People's Republic of China, "Second Office Action," issued in connection with Chinese Patent Application No. 201380079634.4, dated Jun. 4, 2018, 14 pages.
Japan Patent Office, "Notice of Reasons for Rejection," issued in connection with Japanese Patent Application No. 2017-168904, dated Jul. 6, 2018, 3 pages.
State Intellectual Property Office of People's Republic of China, "Third Office Action," issued in connection with Chinese Patent Application No. 201380079634.4, dated Nov. 1, 2018, 20 pages.
Japanese Office Action for Application No. 2016-527978 dated Mar. 28, 2017, 8 pages.
State Intellectual Property Office of People's Republic of China, "First Office Action," issued in connection with Chinese Patent Application No. 201380079634.4, dated Jul. 28, 2017, 18 pages.
Indian Patent Application No. 3425/DELNP/2015 Pre-Grant Opposition, mailed Dec. 4, 2020, 138 pages.
Indian Patent Application No. 3425/DELNP/2015 Pre-Grant Opposition, mailed Jul. 21, 2020, 59 pages.
Indian Patent Application No. 3425/DELNP/2015 Pre-Grant Opposition, mailed Jul. 21, 2020, 96 pages.
Indian Patent Application No. 3425/DELNP/2015 Pre-Grant Opposition, mailed Jul. 2, 2020, 137 pages.
Intellectual Property India, "Examination Report," issued in connection with Indian Patent Application No. 201917009874, dated Nov. 25, 2021, 6 pages.
Australian Office Action, Application No. 2017323502, dated Oct. 22, 2021, 6 pages.
USPTO, "Non-Final Office Action," issued in connection with U.S. Appl. No. 17/403,642, dated Nov. 29, 2021, 13 pages.
China Patent Office, "The Fifth Office Action," issued in connection with China Patent Application No. 2014800719520, dated Oct. 20, 2021, 7 pages.
USPTO, "Non-Final Office Action," issued in connection with U.S. Appl. No. 17/458,947, dated Dec. 15, 2021, 9 pages.
USPTO, "Notice of Allowance," issued in connection with U.S. Appl. No. 16/864,514, dated Jan. 3, 2022, 24 pages.
USPTO, "Notice of Allowance," issued in connection with U.S. Appl. No. 16/419,756, dated Jan. 12, 2022, 16 pages.
USPTO, "Non-Final Office Action," issued in connection with U.S. Appl. No. 16/852,303, dated Jan. 6, 2022, 27 pages.
Intellectual Property India, "Examination Report," issued in connection with Indian Patent Application No. 202147003036, dated Jan. 4, 2022, 5 pages.
Di Carlo, "Inertial microfluidics" Lab on a Chip 9.21 (2009): 3038-3046.
Intellectual Property India, "Examination Report," issued in connection with Indian Patent Application No. 202017054203, dated Jan. 7, 2022, 5 pages.
Kang et al. "Effect of an osmotic differential on the efficiency of gene transfer by electroporation of fish spermatozoa." Aquaculture 173.1-4 (1999): 297-307. (Year: 1999).
Rieth et al. "Electroporation of bovine spermatozoa to carry DNA containing highly repetitive sequences into oocytes and detection of homologous recombination events." Molecular Reproduction and Development: Incorporating Gamete Research 57.4 (2000): 338-345.
Chamberland et al. "The effect of heparin on motility parameters and protein phosphorylation during bovine sperm capacitation. "Theriogenology 55.3 (2001): 823-835. (Year: 2001).
Chan et al. "Luminescent quantum dots for multiplexed biological detection and imaging." Current opinion in biotechnology 13.1 (2002): 40-46. (Year: 2002).
USPTO, "Non-Final Office Action," issued in connection with U.S. Appl. No. 16/561,146, dated Jan. 21, 2022, 14 pages.
USPTO, "Supplemental Notice of Allowability," issued in connection with U.S. Appl. No. 16/864,514, dated Jan. 21, 2022, 5 pages.
USPTO, "Non-Final Office Action," issued in connection with U.S. Appl. No. 17/496,469, dated Jan. 28, 2022, 13 pages.
USPTO, "Final Office Action," issued in connection with U.S. Appl. No. 17/403,642, dated Mar. 4, 2022, 14 pages.
Australian Office Action, Application No. 2021200818, dated Mar. 4, 2022, 3 pages.
USPTO, "Notice of Allowance," issued in connection with U.S. Appl. No. 17/496,469, dated May 10, 2022, 54 pages.
Jun et al. "Detecting and estimating contamination of human DNA samples in sequencing and array-based genotype data." The American Journal of Human Genetics 91.5 (2012): 839-848.
International Searching Authority, "International Search Report and Written Opinion," issued in connection with International Patent Application No. PCT/US21/56094, dated Mar. 16, 2022, 22 pages.
China National Intellectual Property Administration, "Notice of Allowance," issued in connection with Chinese Patent Application No. 201480071952.0, dated Mar. 21, 2022, 3 pages.
USPTO, "Notice of Allowance," issued in connection with U.S. Appl. No. 17/412,789, dated Mar. 21, 2022, 30 pages.
USPTO, "Notice of Allowance," issued in connection with U.S. Appl. No. 17/458,947, dated Mar. 31, 2022, 30 pages.
CNIPA, "First Office Action," issued in connection with Chinese Patent Application No. 202080028183.1, dated Jul. 6, 2022, 21 pages.
New Zealand IP Office, "First Examination Report," issued in connection with New Zealand Patent Application No. 751869, dated Aug. 12, 2022, 3 pages.
Canadian Office Action, Application No. 3,034,007, dated Aug. 25, 2022, 3 pages.
USPTO, "Non-Final Office Action," issued in connection with U.S. Appl. No. 17/403,642, dated Jul. 13, 2022, 7 pages.
USPTO, "Non-Final Office Action," issued in connection with U.S. Appl. No. 17/692,876, dated Sep. 19, 2022, 21 pages.
USPTO, "Notice of Allowance," issued in connection with U.S. Appl. No. 17/403,642, dated Sep. 29, 2022, 24 pages.
European Patent Office, "European Search Report," issued in connection with European Patent Application No. 20792020.8, dated Dec. 23, 2022, 10 pages.
Brazilian Office Action, Application No. BR112020023607-1, dated Dec. 12, 2022, 5 pages.
USPTO, "Non-Final Office Action," issued in connection with U.S. Appl. No. 17/496,614, dated Dec. 21, 2022, 9 pages.
UPSTO, "Non-Final Office Action," issued in connection with U.S. Appl. No. 16/852,303, dated Jan. 9, 2023, 30 pages.
Ron Bardell et al. "Microfluidic disposables for cellular and chemical detection: CFD model results and fluidic erification experiments," Proc SPIE 4265, Biomedical Instrumentation Based on Micro- and Nanotechnology, May 21, 2001; doi: 10.1117/12.427961 Invited Paper: BiOS 2001 The International Symposium on Biomedical Optics, 2001, San Jose, CA, United States, 14 pages.
USPTO, "Non-Final Office Action," issued in connection with U.S. Appl. No. 17/851,319, dated Nov. 2, 2022, 12 pages.
USPTO, "Final Office Action," issued in connection with U.S. Appl. No. 16/279,430, dated Dec. 6, 2022, 18 pages.
European Patent Office, "European Search Report," issued in connection with European Patent Application No. 22190948.4, dated Jan. 23, 2023, 10 pages.
European Patent Office, "Intention to Grant Notice," issued in connection with patent application No. 20167363.9, dated Dec. 15, 2022, 8 pages.
China National Intellectual Property Administration, "Second Office Action," issued in connection with Chinese Patent Application No. 202080028183.1, dated Jan. 13, 2023, 23 pages.
Notice of Allowance issued in U.S. Appl. No. 17/692,876 dated Feb. 1, 2023, 24 pages.

(56) References Cited

OTHER PUBLICATIONS

Notice of Allowance issued in U.S. Appl. No. 17/851,319 dated Feb. 15, 2023, 52 pages.

* cited by examiner

SINGLE-SHEATH MICROFLUIDIC CHIP

BACKGROUND OF THE INVENTION

Field of the Invention

The present invention relates to a microfluidic chip design, in particular, to a microfluidic chip for isolating particles or cellular materials using laminar flow from a single sheath and geometric focusing.

Background Art

Microfluidics enables the use of small volumes for preparing and processing samples, such as various particles or cellular materials. When separating a sample, such as the separation of sperm into viable and motile sperm from non-viable or non-motile sperm, or separation by gender, the process is often a time-consuming task and can have severe volume restrictions. Current separation techniques cannot, for example, produce the desired yield, or process volumes of cellular materials in a timely fashion. Furthermore, existing microfluidic devices do not effectively focus or orient the sperm cells.

Hence, there is need for a microfluidic device and separation process utilizing said device that is continuous, has high throughput, provides time saving, and causes negligible or minimal damage to the various components of the separation. In addition, such a device and method can have further applicability to biological and medical areas, not just in sperm sorting, but in the separation of blood and other cellular materials, including viral, cell organelle, globular structures, colloidal suspensions, and other biological materials.

BRIEF SUMMARY OF THE INVENTION

It is an objective of the present invention to provide microfluidic devices and methods that allow for focusing and orienting particles or cellular materials, as specified in the independent claims. Embodiments of the invention are given in the dependent claims. Embodiments of the present invention can be freely combined with each other if they are not mutually exclusive.

In some aspects, the present invention features microfluidic devices for use in sperm cell sexing and trait enrichment. The microfluidic device may comprise at least one flow focusing region where the components are focused or re-oriented by the geometry of the region. From an upstream end to a downstream end of the flow focusing region, at least a portion of the flow focusing region has a reduction in height and at least a portion narrows in width, thereby geometrically constricting the flow focusing region.

According to some embodiments, the present invention features a microfluidic chip comprising a micro-channel having a constricting portion that narrows in width, and a flow focusing region downstream of the micro-channel, comprising a positively sloping bottom surface that reduces a height of the flow focusing region and sidewalls that taper to reduce a width of the flow focusing region, thereby geometrically constricting the flow focusing region.

In another embodiment, the microfluidic chip may comprise a sample micro-channel, two sheath fluid micro-channels intersecting the sample micro-channel to form an intersection region, a downstream micro-channel fluidly connected to the intersection region, and a downstream flow focusing region fluidly connected to the downstream micro-channel. The downstream micro-channel may have a constricting portion that narrows in width. The flow focusing region may comprise a positively sloping bottom surface that reduces a height of the flow focusing region and sidewalls that taper to reduce a width of the flow focusing region, thereby geometrically constricting the flow focusing region. The sample micro-channel is configured to flow a sample fluid mixture, and the two sheath fluid micro-channels are each configured to flow a sheath fluid into the intersection region to cause laminar flow and to compress the sample fluid mixture flowing from the sample micro-channel at least horizontally from at least two sides such that the sample fluid mixture becomes surrounded by sheath fluid and compressed into a thin stream. The intersection region and the downstream flow focusing region are configured to focus a material in the sample fluid mixture. Compression of the sample fluid mixture centralizes the material within the sample fluid mixture such that the material is focused at or near a center of the downstream micro-channel.

In some embodiments, the constricting portion of the micro-channel comprises sidewalls that taper. In other embodiments, the positively sloping bottom surface and tapering sidewalls occur simultaneously from an upstream end to a downstream end of the flow focusing region. The positively sloping bottom surface and tapering sidewalls may start from a plane that perpendicularly traverses the flow focusing region. In some other embodiments, the sample micro-channel includes a narrowing region downstream of an inlet of the sample micro-channel. The narrowing region may comprise a positively sloping bottom surface that reduces a height of the narrowing region, and sidewalls that taper to reduce a width of the narrowing region. The positively sloping bottom surface and tapering sidewalls can geometrically constrict the narrowing region.

In one embodiment, an outlet of the sample micro-channel is positioned at or near mid-height of an outlet of each of the two sheath fluid micro-channels. An inlet of the downstream micro-channel is positioned at or near mid-height of the outlet of each of the two sheath fluid micro-channels. In another embodiment, the outlet of the sample micro-channel is positioned at or near mid-height of the intersection region. The inlet of the downstream micro-channel is positioned at or near mid-height of the intersection region. In yet another embodiment, the outlet of the sample micro-channel and the inlet of the downstream micro-channel may be aligned or may not be aligned.

In some embodiments, the microfluidic chip may further comprise an interrogation region downstream of the flow focusing region. The microfluidic chip may include an expansion region downstream of the interrogation region. The expansion region may comprise a negatively sloping bottom surface that increases a height of the expansion region, and an expansion portion having sidewalls that widen to increase a width of the expansion region. In other embodiments, the microfluidic chip may further comprise a plurality of output micro-channels downstream of and fluidly coupled to the expansion region.

According to other embodiments, the present invention provides methods that utilize the microfluidic chip. In some embodiments, the present invention features a method of focusing particles in a fluid flow, comprising providing a microfluidic chip, flowing a fluid mixture comprising the particles into the sample micro-channel and into the intersection region, flowing a sheath fluid through the two sheath fluid micro-channels and into the intersection region such that the sheath fluid causes laminar flow and compresses the fluid mixture at least horizontally from at least two sides where the fluid mixture becomes surrounded by sheath fluid and compressed into a thin stream and the particles are constricted into the thin stream surrounded by the sheath fluid, flowing the fluid mixture and sheath fluids into the downstream micro-channel where the constricting portion of the downstream micro-channel horizontally compresses the thin stream of fluid mixture, and flowing the fluid mixture and sheath fluids into the focusing region where the positively sloping bottom surface and tapering sidewalls further constrict the fluid mixture stream and re-orient the particles within the stream, thereby focusing the particles.

In other embodiments, the present invention features a method of producing a fluid with gender-skewed sperm cells. The method may comprise providing a microfluidic chip, flowing a semen fluid comprising sperm cells into the sample micro-channel and into the intersection region, flowing a sheath fluid through the two sheath fluid micro-channels and into the intersection region such that the sheath fluid causes laminar flow and compresses the semen fluid at least horizontally from at least two sides where the semen fluid becomes surrounded by sheath fluid and compressed into a thin stream, flowing the semen fluid and sheath fluids into the downstream micro-channel where the constricting portion horizontally compresses the thin stream of semen fluid, flowing the semen fluid and sheath fluids into the focusing region where the positively sloping bottom surface and tapering sidewalls further constrict the semen fluid stream to focus the sperm cells at or near a center the semen fluid stream, determining a chromosome type of the sperm cells in the semen fluid stream, where each sperm cell is either a Y-chromosome-bearing sperm cell or an X-chromosome-bearing sperm cell, and sorting Y-chromosome-bearing sperm cells from X-chromosome-bearing sperm cells, thereby producing the fluid comprising gender-skewed sperm cells that are predominantly Y-chromosome-bearing sperm cells.

One of the unique and inventive technical features of the present invention is the physical restriction of the channel geometry at the flow focusing region. Without wishing to limit the invention to any theory or mechanism, it is believed that the technical feature of the present invention advantageously eliminates a second sheath flow structure from the microfluidic device such that the use of a secondary sheath fluid to focus/orient sperm cells becomes unnecessary, thus reducing the volume of sheath fluid used as compared to existing devices that have two focusing regions using sheath fluids for stream compression. This provides an additional benefit of reducing operational costs for equipment and supplies, and further simplifying system complexity. None of the presently known prior references or work has the unique inventive technical feature of the present invention.

The inventive technical feature of the present invention surprisingly resulted in equivalent purity, better performance, and improved functionality for Y-skewed sperm cells as compared to the prior devices having two focusing regions using sheath fluids. For instance, the microfluidic device of the present invention unexpectedly improved the orientation of the sperm cells, which is believed to have increased the eligibility, i.e. higher number of cells detected, sorted, and ablated. In addition, the device of the present invention was able to enhance resolution between the Y-chromosome bearing sperm cells and the X-chromosome bearing sperm cells, which resulted in effective discrimination of Y-chromosome-bearing sperm cells.

Further still, the prior references teach away from the present invention. For example, contrary to the present invention, U.S. Pat. No. 7,311,476 teaches the use of sheath fluids to focus a fluid stream in its disclosure of microfluidic chips that have at least two regions, where each region introduces sheath fluids to focus the sheath fluid around particles, and that the second (downstream) region requires the introduction of additional sheath fluid to achieve the necessary focusing.

In some embodiments, the microfluidic chip includes a plurality of layers in which are disposed a plurality of channels including: a sample input channel into which a sample fluid mixture of components to be isolated is inputted, and two focusing regions comprising a first focusing region that focuses particles in the sample fluid and a second focusing region that focuses particles in the sample fluid, where one of the focusing regions includes introduction of a sheath fluid via one or more sheath fluid channels, and the other focusing region includes geometric compression without introducing additional sheath fluid. Geometric compression refers to physical restriction due to a narrowing in size of the sample channel in both the vertical and horizontal axes (i.e. from above and below and from both the left and right sides, relative to the direction of travel along the sample channel). In some aspects, the first focusing region may combine geometric with the sheath fluid introduction however, the second focusing region does not utilize additional sheath fluid for stream focusing or particle orienting. In other aspects, the microfluidic chip can be loaded on a microfluidic chip cassette which is mounted on a microfluidic chip holder.

In some embodiments, the sample input channel and the one or more sheath channels are disposed in one or more planes of the microfluidic chip. For instance, a sheath channel may be disposed in a different plane than a plane in which the sample input channel is disposed. In other embodiments, the sample input channel and the sheath channels are disposed in one or more structural layers, or in-between structural layers of the microfluidic chip. As an example, the one or more sheath channels may be disposed in a different structural layer than a structural layer in which the sample input channel is disposed.

In one embodiment, the sample input channel may taper at an entry point into the intersection region with the sheath channel. In another embodiment, the sheath channel may taper at entry points into the intersection region with the sample input channel. In some embodiments, the microfluidic device may include one or more output channels fluidly coupled to the sample channel. The one or more output channels may each have an output disposed at its end. In other embodiments, the microfluidic chip may further include one or more notches disposed at a bottom edge of the microfluidic chip to isolate the outputs of the output channels.

In some embodiments, the microfluidic chip system includes an interrogation apparatus which interrogates and identifies the components of the sample fluid mixture in the sample input channel, in an interrogation chamber disposed downstream from the flow focusing region. In one embodiment, the interrogation apparatus includes a radiation source configured to emit a beam to illuminate and excite the components in said sample fluid mixture. The emitted light induced by the beam is received by an objective lens. In another embodiment, the interrogation apparatus may comprise a detector such as a photomultiplier tube (PMT), an avalanche photodiode (APD), or a silicon photomultiplier (SiPM).

In some embodiments, the microfluidic chip includes a sorting mechanism which sorts said components in said sample fluid mixture downstream from said interrogation chamber, by selectively acting on individual components in said sample fluid mixture. In one embodiment, the sorting mechanism may comprise a laser kill/ablation. Other examples of sorting mechanisms that may be used in accordance with the present invention include, but are not limited to, particle deflection/electrostatic manipulation, droplet sorting/deflection, mechanical sorting, fluid switching, piezoelectric actuation, optical manipulation (optical trapping, holographic steering, and photonic/radiation pressure), surface acoustic wave (SAW) deflection, electrophoresis/electrical disruption, micro-cavitation (laser induced, electrically induced). In some embodiments, the isolated components are moved into one of the output channels, and unselected components flow out through another output channel.

In further embodiments, the microfluidic chip may be operatively coupled to a computer which controls the pumping of one of the sample fluid mixture or the sheath fluid into the microfluidic chip. In another embodiment, the computer can display the components in a field of view acquired by a CCD camera disposed over the interrogation window in the microfluidic chip.

In some embodiments, the cells to be isolated may include at least one of viable and motile sperm from non-viable or non-motile sperm; sperm isolated by gender and other sex sorting variations; stem cells isolated from cells in a population; one or more labeled cells isolated from unlabeled cells including sperm cells; cells, including sperm cells, distinguished by desirable or undesirable traits; genes isolated in nuclear DNA according to a specified characteristic; cells isolated based on surface markers; cells isolated based on membrane integrity or viability; cells isolated based on potential or predicted reproductive status; cells isolated based on an ability to survive freezing; cells isolated from contaminants or debris; healthy cells isolated from damaged cells; red blood cells isolated from white blood cells and platelets in a plasma mixture; or any cells isolated from any other cellular components into corresponding fractions.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE SEVERAL VIEWS OF THE DRAWING(S)

The features and advantages of the present invention will become apparent from a consideration of the following detailed description presented in connection with the accompanying drawings in which.

DETAILED DESCRIPTION OF THE INVENTION

Figure 1A:
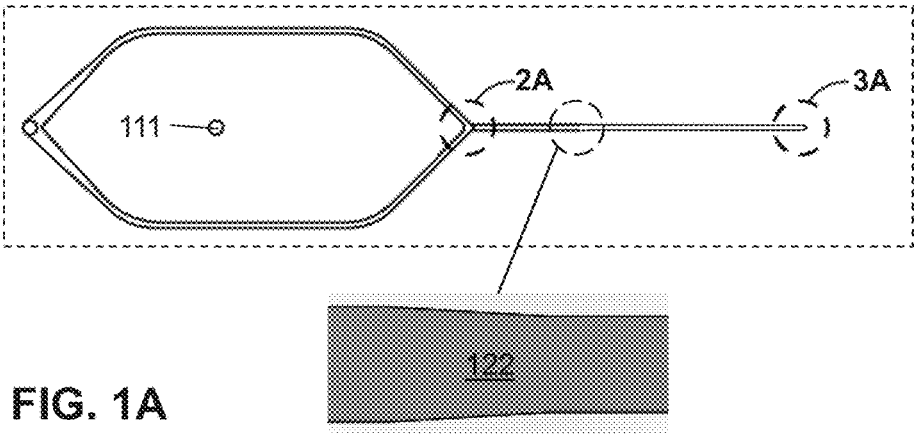
FIG. 1A shows a bottom view of a top layer of a microfluidic device according to an embodiment of the present invention.
Figure 1B:
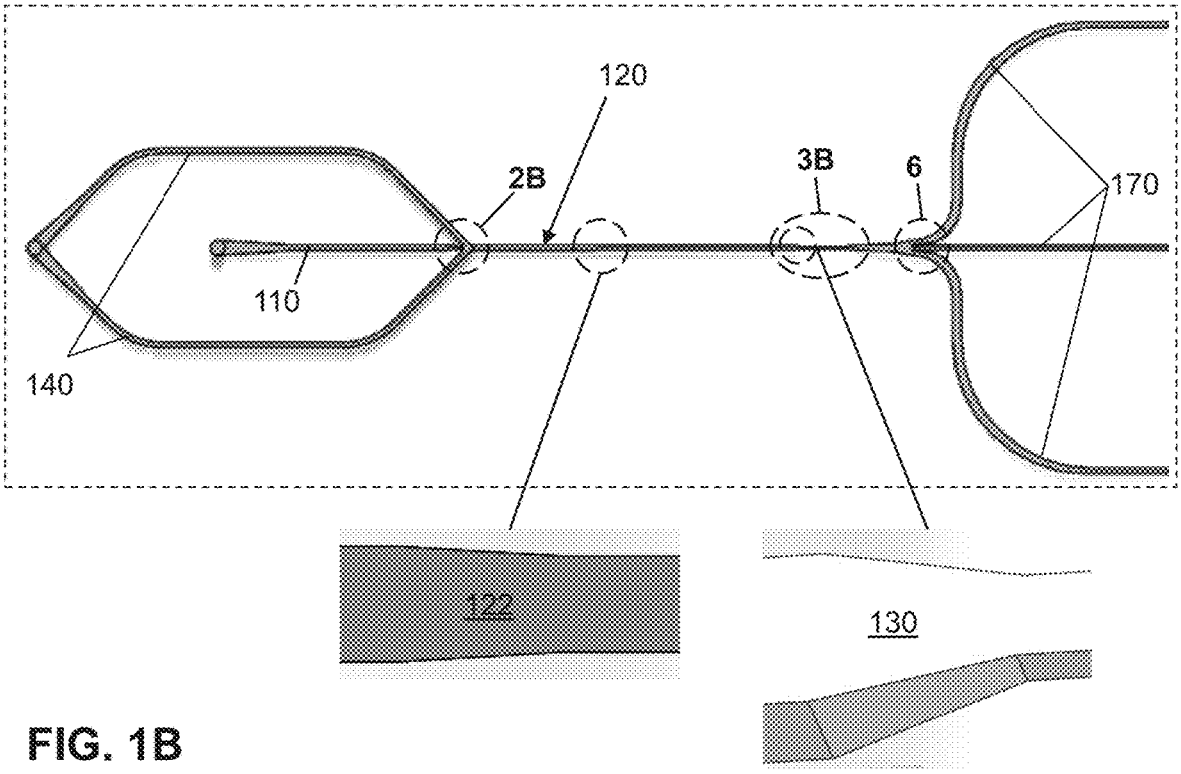
FIG. 1B shows a top view of a bottom layer of the microfluidic device.
Figure 1C:
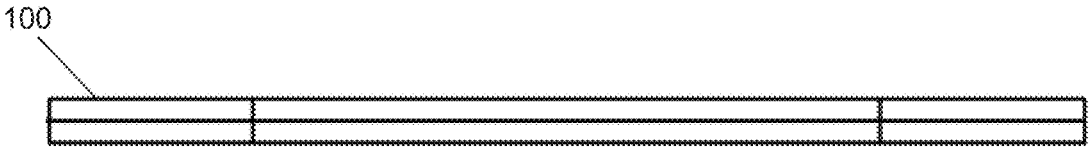
FIG. 1C is a side view of the top layer stacked on the bottom layer of the microfluidic device.
Figure 2A:
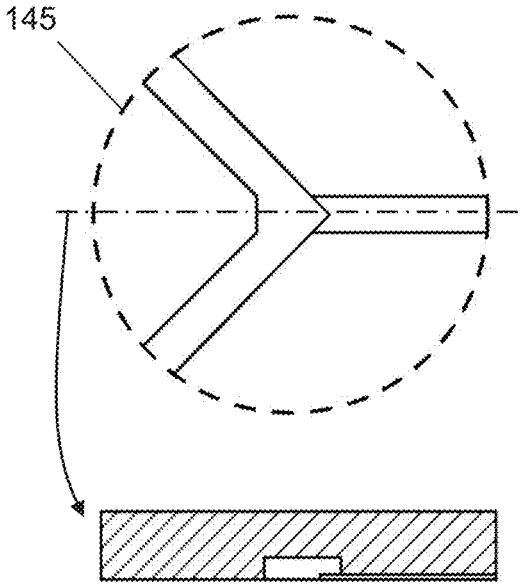
FIG. 2A shows a close-up view and a cross-sectional side view of an intersection region in the top layer shown in FIG. 1A.
Figure 2B:
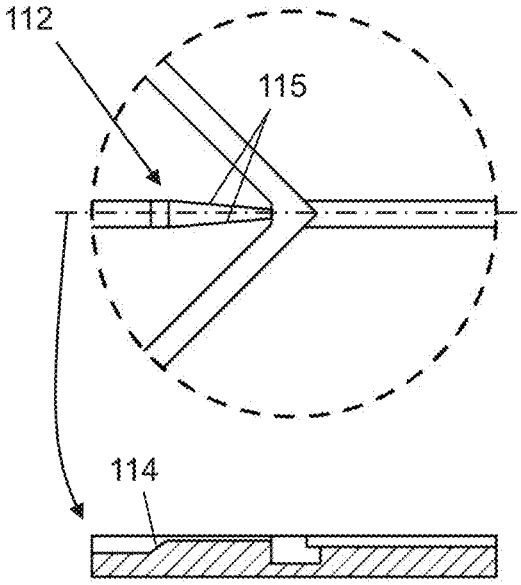
FIG. 2B shows a close-up view and a cross-sectional side view of the intersection region in the bottom layer shown in FIG. 1B.
Figure 2C:
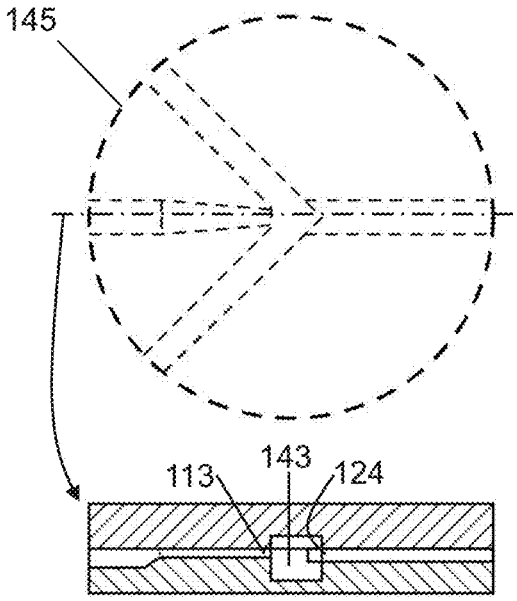
FIG. 2C shows a close-up view and a cross-sectional side view of the intersection region in the stacked layers shown in FIG. 1C.
Figure 3A:
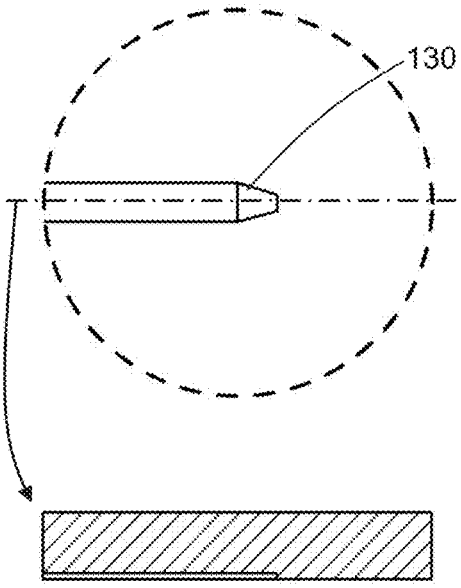
FIG. 3A shows a close-up view and a cross-sectional side view of a flow focusing region in the top layer shown in FIG. 1A.
Figure 3B:
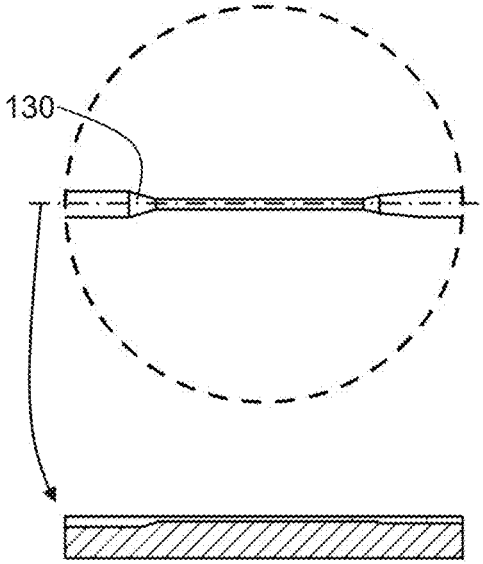
FIG. 3B shows a close-up view and a cross-sectional side view of the flow focusing region in the bottom layer shown in FIG. 1B.
Figure 3C:
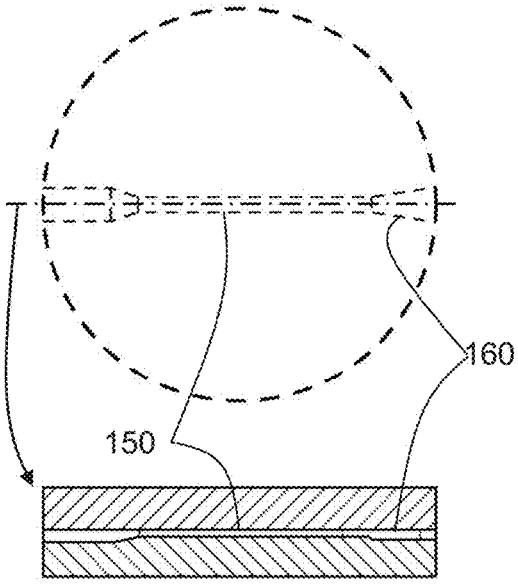
FIG. 3C shows a close-up view and a cross-sectional side view of the flow focusing region in the stacked layers shown in FIG. 1C.
Figure 4:
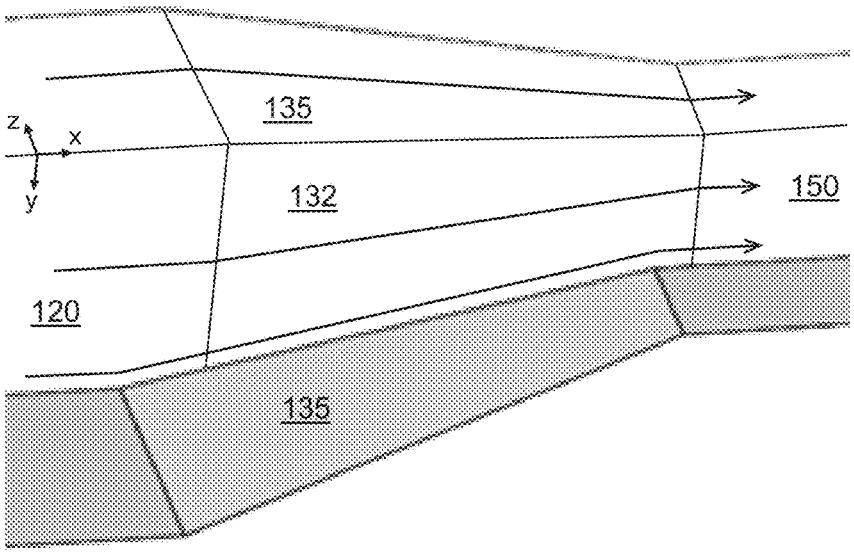
FIG. 4 shows a close-up view of the flow focusing region shown in FIG. 1B.
Figure 5:
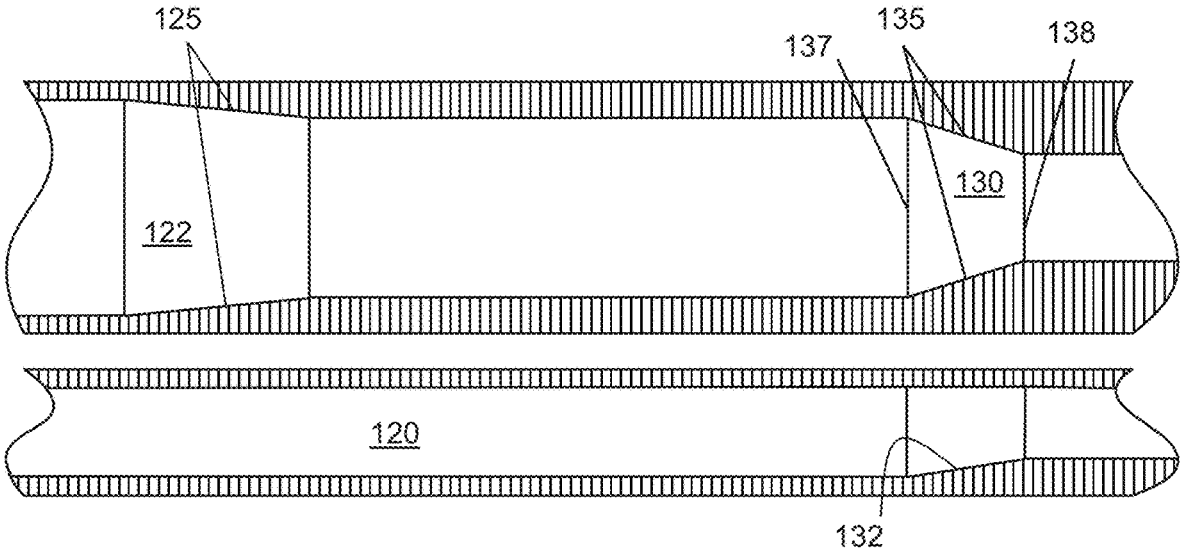
FIG. 5 shows a non-limiting embodiment of a top view and a side view of a downstream micro-channel and the flow focusing region. This embodiment shows the constricting portion of the downstream micro-channel and the simultaneous geometric compression by the bottom surface and sidewalls of the flow focusing region.

Before turning to the figures, which illustrate the illustrative embodiments in detail, it should be understood that the present disclosure is not limited to the details or methodology set forth in the description or illustrated in the figures. It should also be understood that the terminology is for the purpose of description only and should not be regarded as limiting. An effort has been made to use the same or like reference numbers throughout the drawings to refer to the same or like parts.

Following is a list of elements corresponding to a particular element referred to herein:

100 microfluidic chip
110 sample micro-channel
111 inlet of sample micro-channel
112 narrowing region
113 outlet of sample micro-channel
114 bottom surface of narrowing region
115 sidewalls of narrowing region
120 downstream micro-channel
122 constricting portion
124 inlet of downstream micro-channel
125 sidewalls of constricting portion
130 flow focusing region
132 bottom surface of flow focusing region
135 sidewalls of flow focusing region
137 upstream end of flow focusing region
138 downstream end of flow focusing region
140 sheath fluid micro-channels
143 outlet of sheath fluid micro-channel
145 intersection region
150 interrogation region
160 expansion region
162 bottom surface of expansion region
165 sidewalls of expansion region
170 output micro-channel In one aspect, the present disclosure relates to a microfluidic chip design and methods that can isolate particles or cellular materials, such as sperm and other particles or cells, into various components and fractions. For example, the various embodiments of the present invention provide for isolating components in a mixture, such as isolating viable and motile sperm from non-viable or non-motile sperm; isolating sperm by gender, and other sex sorting variations; isolating stems cells from cells in a population; isolating one or more labeled cells from un-labeled cells distinguishing desirable/undesirable traits; isolating genes in nuclear DNA according to a specified characteristic; isolating cells based on surface markers; isolating cells based on membrane integrity (viability), potential or predicted reproductive status (fertility), ability to survive freezing, etc.; isolating cells from contaminants or debris; isolating healthy cells from damaged cells (i.e., cancerous cells) (as in bone marrow extractions); red blood cells from white blood cells and platelets in a plasma mixture; and isolating any cells from any other cellular components, into corresponding fractions.

In other aspects, the various embodiments of the present invention provide systems and methods particularly suited for sorting sperm cells to produce a sexed semen product in which live, progressively motile sperm cells are predominantly Y-chromosome bearing sperm cells. In some embodiments, the systems and methods of the present invention can produce a sex-sorted or gender skewed semen product comprising at least 55% of Y-chromosome bearing sperm cells. In other embodiments, the systems and methods can produce a sexed semen product comprising about 55% to about 90% of Y-chromosome bearing sperm cells. In yet other embodiments, the systems and methods can produce a sexed semen product comprising at least 90%, or at least 95%, or at least 99% of Y-chromosome bearing sperm cells.

While the description below focuses on the separation of sperm into viable and motile sperm from non-viable or non-motile sperm, or isolating sperm by gender and other sex sorting variations, or isolating one or more labeled cells from unlabeled cells distinguishing desirable/undesirable traits, etc., the present invention may be extended to other types of particulate, biological or cellular matter, which are capable of being interrogated by fluorescence techniques within a fluid flow, or which are capable of being manipulated between different fluid flows into different outputs.

The various embodiments of the microfluidics chip utilize one or more flow channels having substantially laminar flow, and a flow focusing region for focusing and/or orienting one or more components in the fluid, allowing the one or more components to be interrogated for identification and to be isolated into flows that exit into one or more outputs. In addition, the various components in the mixture may be subjected to one or more sorting processes on-chip using various sorting techniques, such as, for example, particle deflection/electrostatic manipulation; droplet sorting/deflection; mechanical sorting; fluid switching; piezoelectric actuation; optical manipulation (optical trapping, holographic steering, and photonic/radiation pressure); laser kill/ablation; surface acoustic wave (SAW) deflection; electrophoresis/electrical disruption; micro-cavitation (laser induced, electrically induced); or by magnetics (i.e., using magnetic beads). The various embodiments of the present invention thereby provide focusing and separation of components on a continuous basis without the potential damage and contamination of prior art methods, particularly as provided in sperm separation. The continuous process of the invention also provides significant time savings in isolating the fluid components.

Microfluidic Chip Assembly

Referring to FIGS. 1A-6, the present invention features a microfluidic chip (100). A non-limiting embodiment of the microfluidic chip (100) comprises a sample micro-channel (110), two sheath fluid micro-channels (140) intersecting the sample micro-channel (110) to form an intersection region (145), a downstream micro-channel (120) fluidly connected to the intersection region (145), the downstream micro-channel (120) having a constricting portion (122) that narrows in width, and a downstream flow focusing region (130) fluidly connected to the downstream micro-channel (120). The flow focusing region (130) may comprise a positively sloping bottom surface (132) that reduces a height of the flow focusing region and sidewalls (135) that taper to reduce a width of the flow focusing region, thereby geometrically constricting the flow focusing region (130).

Without wishing to limit the invention to a particular theory or mechanism, the sample micro-channel (110) is configured to flow a sample fluid mixture, and the two sheath fluid micro-channels (140) are each configured to flow a sheath fluid into the intersection region (145). The flow of sheath fluid causes laminar flow and compression of the sample fluid mixture flowing from the sample micro-channel (110) at least horizontally from at least two sides such that the sample fluid mixture becomes surrounded by sheath fluid and compressed into a thin stream. In further iterations, additional sheath flows may be incorporated to focus and/or adjust the location of the sample stream within the microchannel. Such sheath flows may be introduced from one or more directions (i.e. top, bottom, and/or sides), and may be introduced simultaneously or in succession.

In some embodiments, the constricting portion (122) of the micro-channel comprises sidewalls (125) that taper. For example, the sidewalls (125) may taper such that the width of the micro-channel is reduced from 150 um to 125 um.

In some embodiments, the positively sloping bottom surface (132) and tapering sidewalls (135) occur simultaneously from an upstream end (137) to a downstream end (138) of the flow focusing region. Thus, the positively sloping bottom surface (132) and tapering sidewalls (135) have the same starting point. For example, the positively sloping bottom surface (132) and tapering sidewalls (135) each begin from a same plane that perpendicularly traverses the flow focusing region (130).

In other embodiments, the sample micro-channel (110) includes a narrowing region (112) downstream of an inlet (111) of the sample micro-channel. The narrowing region (112) may comprise a positively sloping bottom surface (114) that reduces a height of the narrowing region, and sidewalls (115) that taper to reduce a width of the narrowing region. The positively sloping bottom surface (114) and tapering sidewalls (115) can geometrically constrict the narrowing region (112).

In some embodiments, an outlet (113) of the sample micro-channel may be positioned at or near mid-height of an outlet (143) of each of the two sheath fluid micro-channels. An inlet (124) of the downstream micro-channel may be positioned at or near mid-height of the outlet (143) of each of the two sheath fluid micro-channels. The outlet (113) of the sample micro-channel and the inlet (124) of the downstream micro-channel may be aligned. In other embodiments, the outlet (113) of the sample micro-channel may be positioned at or near mid-height of the intersection region and the inlet (124) of the downstream micro-channel may be positioned at or near mid-height of the intersection region.

Without wishing to limit the invention to a particular theory or mechanism, the intersection region (145) and the downstream flow focusing region (130) are configured to focus a material in the sample fluid mixture. For example, compression of the sample fluid mixture centralizes the material within the sample fluid mixture such that the material is focused at or near a center of the downstream micro-channel.

In some embodiments, the microfluidic chip (100) may further comprise a plurality of output micro-channels (170) downstream of and fluidly coupled to the expansion region (160). The output micro-channels (170) are configured to output fluids, which may have components such as particles or cellular material. The output channels may each have an output disposed at its end. In other embodiments, the microfluidic chip may further include one or more notches disposed at a bottom edge of the microfluidic chip to separate the outputs and to provide attachments for external tubing etc. A non-limiting embodiment of the chip may comprise three output channels, which include two side output channels and a center output channel disposed between said side channels.

In some embodiments, the micro-channels and various regions of the microfluidic chip may be dimensioned so as to achieve a desired flow rate(s) that meets the objective of the present invention. In one embodiment, the micro-channels may have substantially the same dimensions, however, one of ordinary skill in the art would know that the size of any or all of the channels in the microfluidic chip may vary in dimension (i.e., between 50 and 500 microns), as long as the desired flow rate(s) is achieved.

In some other embodiments, the microfluidic chip (100) may further comprise an interrogation region (150) downstream of the flow focusing region (130). In yet other embodiments, the microfluidic chip (100) may include an expansion region (160) downstream of the interrogation region (150). The expansion region (160) may comprise a negatively sloping bottom surface (162) that increases a height of the expansion region, and an expansion portion having sidewalls (165) that widen to increase a width of the expansion region.

In one embodiment, the interrogation apparatus includes a chamber with an opening or window cut into the microfluidic chip. The opening or window can receive a covering to enclose the interrogation chamber. The covering may be made of any material with the desired transmission requirements, such as plastic, glass, or may even be a lens. In one embodiment, the window and covering allow the components of the fluid mixture flowing through the interrogation chamber to be viewed, and acted upon by a suitable radiation source configured to emit a high intensity beam with any wavelength that matches the excitation of the components.

Although a laser may be used, it is understood that other suitable radiation sources may be used, such as a light emitting diode (LED), arc lamp, etc. to emit a beam which excites the components. In another embodiment, the light beam can be delivered to the components by an optical fiber that is embedded in the microfluidic chip at the opening.

In some embodiments, a high intensity laser beam from a suitable laser of a preselected wavelength—such as a 355 nm continuous wave (CW) (or quasi-CW) laser—is required to excite the components in the fluid mixture (i.e., sperm cells). The laser emits a laser beam through the window so as to illuminate the components flowing through the interrogation region of the chip. Since the laser beam can vary in intensity widthwise along the micro-channel, with the highest intensity generally at the center of the micro-channel (e.g., midsection of the channel width) and decreasing therefrom, it is imperative that the flow focusing region focuses the sperm cells at or near the center of the fluid stream where optimal illumination occurs at or near the center of the illumination laser spot. Without wishing to be bound to a particular belief, this can improve accuracy of the interrogation and identification process In some embodiments, the high intensity beam interacts with the components such that the emitted light, which is induced by the beam, is received by an objective lens. The objective lens may be disposed in any suitable position with respect to the microfluidic chip. In one embodiment, the emitted light received by the objective lens is converted into an electronic signal by an optical sensor, such as a photomultiplier tube (PMT) or photodiode, etc. The electronic signal can be digitized by an analog-to-digital converter (ADC) and sent to a digital signal processor (DSP) based controller. The DSP based controller monitors the electronic signal and may then trigger a sorting mechanism.

In other embodiments, the interrogation apparatus may comprise a detector such as a photomultiplier tube (PMT), an avalanche photodiode (APD), or a silicon photomultiplier (SiPM). For example, the optical sensor of the interrogation apparatus may be APD, which is a photodiode with substantial internal signal amplification through an avalanche process.

In some embodiments, a piezoelectric actuator assembly may be used to sort the desired components in the fluid mixture as the components leave the interrogation area after interrogation. A trigger signal sent to the piezoelectric actuator is determined by the sensor raw signal to activate a particular piezoelectric actuator assembly when the selected component is detected. In some embodiments, a flexible diaphragm made from a suitable material, such as one of stainless steel, brass, titanium, nickel alloy, polymer, or other suitable material with desired elastic response, is used in conjunction with an actuator to push target components in the micro-channel into an output channel (170) to isolate the target components from the fluid mixture. The actuator may be a piezoelectric, magnetic, electrostatic, hydraulic, or pneumatic type actuator.

In alternative embodiments, a piezoelectric actuator assembly or a suitable pumping system may be used to pump the sample fluid into the micro-channel (110) toward the intersection region (145). The sample piezoelectric actuator assembly may be disposed at sample inlet (111). By pumping the sample fluid mixture into the main micro-channel, a measure of control can be made over the spacing of the components therein, such that a more controlled relationship may be made between the components as they enter the micro-channel (110).

Other embodiments of sorting or separating mechanisms that may be used in accordance with the present invention include, but are not limited to, droplet sorters, mechanical separation, fluid switching, acoustic focusing, holographic trapping/steering, and photonic pressure/steering. In a preferred embodiment, the sorting mechanism for sex-sorting of sperm cells comprises laser kill/ablation of selected X-chromosome-bearing sperm cells.

In laser ablation, the laser is activated when an X-chromosome-bearing sperm cell is detected during interrogation. The laser emits a high intensity beam directed at the X-chromosome-bearing sperm cell centered within the fluid stream. The high intensity beam is configured to cause DNA and/or membrane damage to the cell, thereby causing infertility or killing the X-chromosome-bearing sperm cell. As a result, the final product is comprised predominantly of viable Y-chromosome-bearing sperm cells. In preferred embodiments, the reduction in the cross-sectional area of the flow focusing region geometrically compresses the fluid that carries sperm cells. The geometric compression of the fluid centralizes the sperm cells within the fluid such that the sperm cells are focused at or near a center of the micro-channel. Since the laser beam varies in intensity widthwise along the micro-channel, with the highest intensity generally at the center of micro-channel and decreasing therefrom, it is imperative that the flow focusing region focuses the sperm cells at or near the center of the fluid stream where the laser beam has the highest intensity to impart maximum damage to the selected sperm cells.

Chip Operation

In one embodiment, as previously stated, the components that are to be isolated include, for example: isolating viable and motile sperm from non-viable or non-motile sperm; isolating sperm by gender, and other sex sorting variations; isolating stems cells from cells in a population; isolating one or more labeled cells from un-labeled cells distinguishing desirable/undesirable traits; sperm cells with different desirable characteristics; isolating genes in nuclear DNA according to a specified characteristic; isolating cells based on surface markers; isolating cells based on membrane integrity (viability), potential or predicted reproductive status (fertility), ability to survive freezing, etc.; isolating cells from contaminants or debris; isolating healthy cells from damaged cells (i.e., cancerous cells) (as in bone marrow extractions); red blood cells from white blood cells and platelets in a plasma mixture; and isolating any cells from any other cellular components, into corresponding fractions; damaged cells, or contaminants or debris, or any other biological materials that are desired to isolated. The components may be cells or beads treated or coated with, linker molecules, or embedded with a fluorescent or luminescent label molecule(s). The components may have a variety of physical or chemical attributes, such as size, shape, materials, texture, etc.

In one embodiment, a heterogeneous population of components may be measured simultaneously, with each component being examined for different quantities or regimes in similar quantities (e.g., multiplexed measurements), or the components may be examined and distinguished based on a label (e.g., fluorescent), image (due to size, shape, different absorption, scattering, fluorescence, luminescence characteristics, fluorescence or luminescence emission profiles, fluorescent or luminescent decay lifetime), and/or particle position etc.

In one embodiment, a focusing method may be used in order to position the components for interrogation in the interrogation chamber. A first constricting step of the present invention is accomplished by inputting a fluid sample containing components, such as sperm cells etc., through sample input (111), and inputting sheath or buffer fluids through the sheath or buffer micro-channels (140). In some embodiments, the components are pre-stained with dye (e.g., Hoechst dye), in order to allow fluorescence, and for imaging to be detected. Initially, the components in the sample fluid mixture flow through micro-channel (110) and have random orientation and position. At the intersection region (145), the sample mixture flowing in the micro-channel (110) is compressed by the sheath or buffer fluids flowing from the sheath or buffer micro-channels (140) at least horizontally on at least both sides of the flow, if not all sides. As a result, the components are focused and compressed into a thin stream and the components (e.g., sperm cells) move toward a center of the channel width. This step is advantageous in that the less sheath fluid is used since sheath fluid in only introduced at one location in the chip.

In another embodiment, the present invention includes a second constricting step where the sample mixture containing the components is further compressed, at least horizontally, by the constricting region (122) of the downstream micro-channel. This step utilizes physical or geometric compression instead of another intersection of sheath fluids. Thus, with the second constricting step of the present invention, the sample stream is focused at the center of the channel, and the components flow along the center of the channel. In preferred embodiments, the components are flowing in approximately single file formation. Without wishing to be bound to a particular theory or mechanism, the physical/geometric compression has the advantage of reducing the volume of sheath fluid since a second intersection of sheath fluids is eliminated.

In preferred embodiments, the present invention includes a focusing step where the sample mixture containing the components is further compressed in the flow focusing region (130) using physical or geometric compression, instead of another intersection of sheath fluids. The sample mixture is also positioned closer to a top surface of the focusing region (130) by the upward sloping bottom surface. Thus, with the focusing step of the present invention, the sample stream is focused at the center of the channel, and the components flow along the center of the channel in approximately a single file formation. Without wishing to be bound to a particular theory or mechanism, the physical/geometric compression has the advantage of reducing the volume of sheath fluid since the second intersection of sheath fluids is eliminated.

Accordingly, the microfluidic devices described herein may be used in the focusing method described above. In one embodiment, the present invention provides a method of focusing particles in a fluid flow. The method may comprise providing any one of the microfluidic devices described herein, flowing a fluid mixture comprising the particles into the sample micro-channel (110) and into the intersection region (145), flowing a sheath fluid through the two sheath fluid micro-channels (140) and into the intersection region (145) such that the sheath fluid causes laminar flow and compresses the fluid mixture at least horizontally from at least two sides, wherein the fluid mixture becomes surrounded by sheath fluid and compressed into a thin stream and the particles are constricted into the thin stream surrounded by the sheath fluid, flowing the fluid mixture and sheath fluids into the downstream micro-channel (120), wherein the constricting portion (122) of the downstream micro-channel (120) horizontally compresses the thin stream of fluid mixture, and flowing the fluid mixture and sheath fluids into the focusing region (130), wherein the positively sloping bottom surface (132) and tapering sidewalls (135) of the focusing region further constrict the fluid mixture stream and re-orient the particles within the stream, thereby focusing the particles.

Compression of the fluid mixture, by the introduction of sheath fluid and/or the physical structures at the constricting and focusing regions constricts the particles of the fluid mixture into a relatively smaller, narrower stream bounded by the sheath fluids. For example, sheath fluid introduced into the sample micro-channel (110) by two sheath fluid channels (130) can compress the fluid mixture stream from two sides into a relatively smaller, narrower stream while maintaining laminar flow. Flow of the fluid mixture and sheath fluids in the focusing region causes further constriction of the fluid mixture stream and re-orienting of the particles within the stream, which is caused by the physical structures such as the rising bottom surface (132) and the tapering portions of the sidewalls (135) of the focusing region, thus focusing the particles.

In some embodiments, the components of the sample are sperm cells, and because of their pancake-type or flattened teardrop shaped head, the sperm cells can re-orient themselves in a predetermined direction as they undergo the focusing step—i.e., with their flat surfaces perpendicular to the direction of a light beam. Thus, the sperm cells develop a preference on their body orientation while passing through the two-step focusing process. Specifically, the sperm cells tend to be more stable with their flat bodies perpendicular to the direction of the compression. By controlling the sheath or buffer fluids, the sperm cells which start with random orientation, can achieve uniform orientation. The sperm cells not only make a single file formation at the center of the channel, but they also achieve a uniform orientation. Thus, the components introduced into sample input, which may be other types of cells or other materials as previously described, undergo the focusing steps, which allow the components to move in a single file formation, and in a more uniform orientation (depending on the type of components), which allows for easier interrogation of the components.

Figure 6:
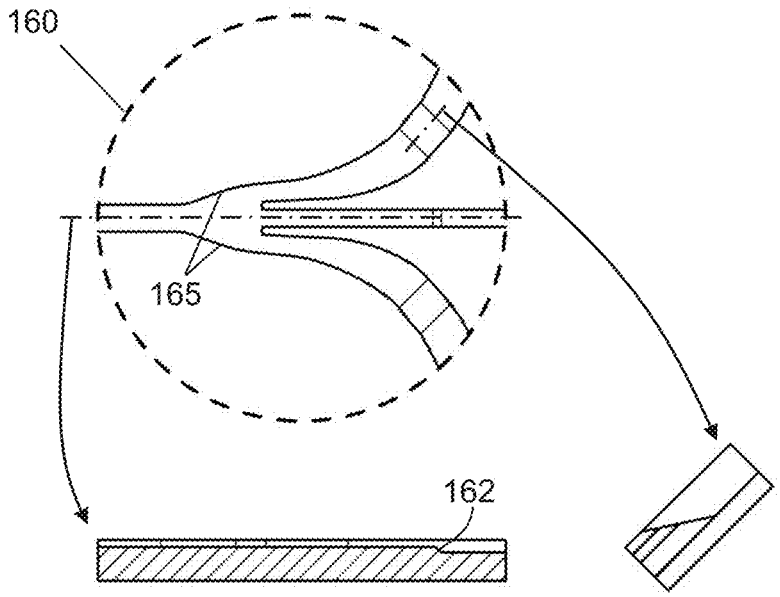
FIG. 6 shows a close-up view and a cross-sectional side view of an output channel region in the bottom layer shown in FIG. 1B.
Figure 7:
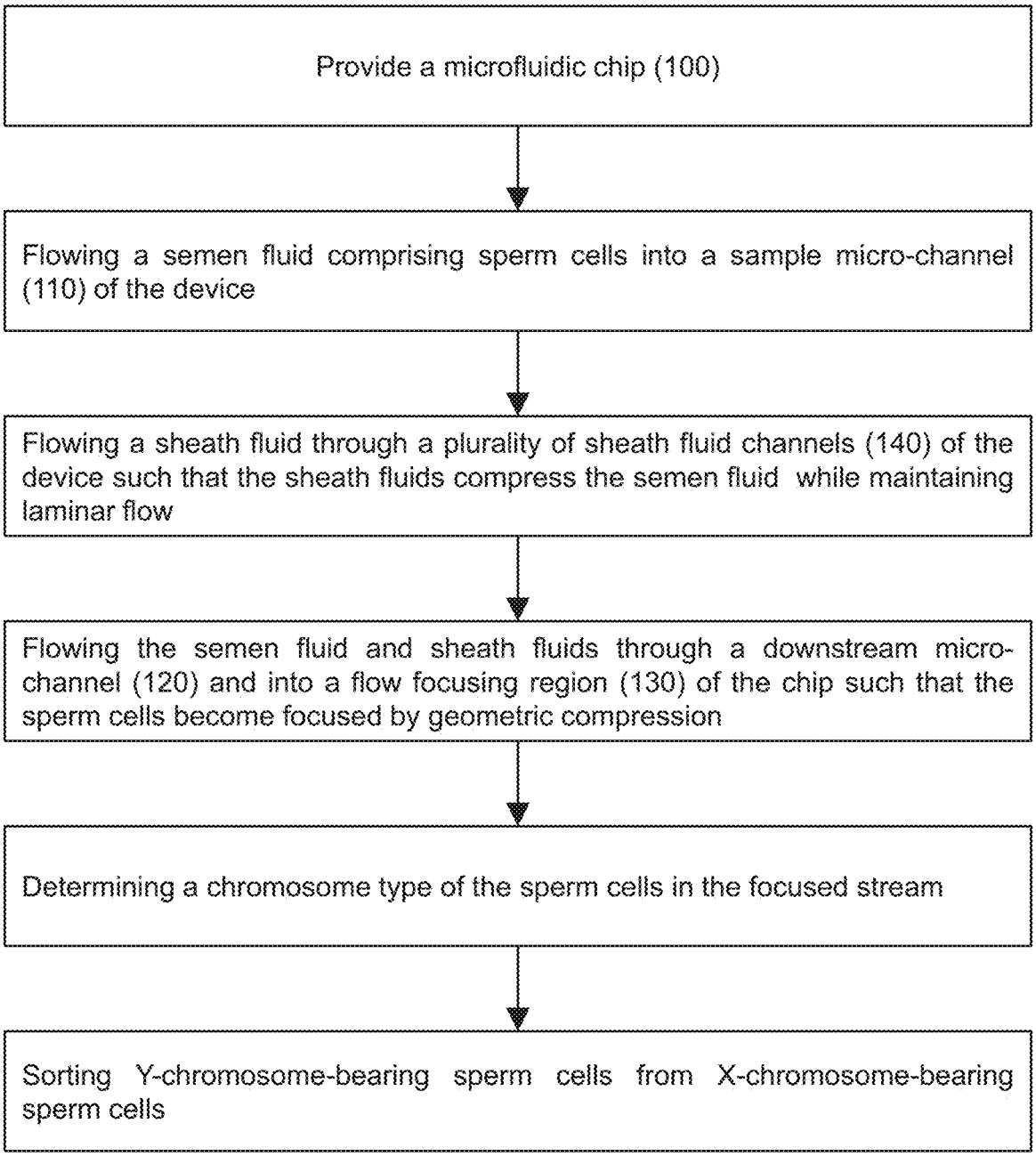
FIG. 7 is a non-limiting example of a flow diagram for a method of gender-skewing a semen fluid sample.

In conjunction with the preceding embodiments, the present invention also provides a method of producing a fluid with gender-skewed sperm cells. Referring to FIG. 6, the method may comprise providing any one of the microfluidic devices described herein, flowing a semen fluid comprising sperm cells into the sample micro-channel (110) and into the intersection region (145), flowing a sheath fluid through the two sheath fluid micro-channels (140) and into the intersection region (145) such that the sheath fluid causes laminar flow and compresses the semen fluid at least horizontally from at least two sides, wherein the semen fluid becomes surrounded by sheath fluid and compressed into a thin stream, flowing the semen fluid and sheath fluids into the downstream micro-channel (120), wherein the constricting portion (122) of the downstream micro-channel (120) horizontally compresses the thin stream of semen fluid, flowing the semen fluid and sheath fluids into the focusing region (130), wherein the positively sloping bottom surface (132) and tapering sidewalls (135) further constrict the semen fluid stream to focus the sperm cells at or near a center the semen fluid stream, determining a chromosome type of the sperm cells in the semen fluid stream, wherein each sperm cell is either a Y-chromosome-bearing sperm cell or an X-chromosome-bearing sperm cell, and sorting Y-chromosome-bearing sperm cells from X-chromosome-bearing sperm cells, thereby producing the fluid comprising gender-skewed sperm cells that are predominantly Y-chromosome-bearing sperm cells.

In some embodiments, the chromosome type of the sperm cells may be determined using any one of the interrogation apparatus described herein. In one embodiment, the microfluidic chip (100) may further comprise an interrogation region (150) downstream of the flow focusing region (130). An interrogation apparatus may be coupled to the interrogation region (150) and used to determine the chromosome type of the sperm cells and sort said sperm cells based on chromosome type. The interrogation apparatus may comprise a radiation source that illuminates and excites the sperm cells, and a response of the sperm cell is indicative of the chromosome type in the sperm cell. The response of the sperm cell may be detected by an optical sensor. In other embodiments, the interrogation apparatus may further comprise a laser source. The Y-chromosome-bearing sperm cells are sorted from the X-chromosome-bearing sperm cells by laser ablation, which exposes the cells to the high intensity laser source that damages or kills cells that are determined to bear an X-chromosome. In one embodiment, the gender-skewed sperm cells are comprised of at least 55% of Y-chromosome-bearing sperm cells. In another embodiment, the gender-skewed sperm cells are comprised of about 55%-99% of Y-chromosome-bearing sperm cells. In yet another embodiment, the gender-skewed sperm cells are comprised of at least 99% of Y-chromosome-bearing sperm cells.

In one embodiment, the components are detected in the interrogation chamber using a radiation source. The radiation source emits a light beam (which may be via an optical fiber) which is focused at the center of the channel widthwise. In one embodiment, the components, such as sperm cells, are oriented by the focusing region such that the flat surfaces of the components are facing toward the beam. In addition, all components are preferably aligned in a single file formation by focusing as they pass under a radiation source. As the components pass under the radiation source and are acted upon by a light beam, the components emit the fluorescence which indicates the desired components. For example, with respect to sperm cells, X chromosome cells fluoresce at a different intensity from Y chromosome cells; or cells carrying one trait may fluoresce in a different intensity or wavelength from cells carrying a different set of traits. In addition, the components can be viewed for shape, size, or any other distinguishing indicators.

In one embodiment, interrogation of the sample containing components (i.e., biological material), is accomplished by other methods. Overall, methods for interrogation may include direct visual imaging, such as with a camera, and may utilize direct bright-light imaging or fluorescent imaging; or, more sophisticated techniques may be used such as spectroscopy, transmission spectroscopy, spectral imaging, or scattering such as dynamic light scattering or diffusive wave spectroscopy. In some cases, the optical interrogation region may be used in conjunction with additives, such as chemicals which bind to or affect components of the sample mixture or beads which are functionalized to bind and/or fluoresce in the presence of certain materials or diseases. These techniques may be used to measure cell concentrations, to detect disease, or to detect other parameters which characterize the components.

However, in another embodiment, if fluorescence is not used, then polarized light back scattering methods may also be used. Using spectroscopic methods, the components are interrogated and the spectrum of those components which had positive results and fluoresced (i.e., those components which reacted with a label) are identified for separation. In some embodiments, the components may be identified based on the reaction or binding of the components with additives or sheath or buffer fluids, or by using the natural fluorescence of the components, or the fluorescence of a substance associated with the component, as an identity tag or background tag, or met a selected size, dimension, or surface feature, etc., are selected for separation. In one embodiment, upon completion of an assay, selection may be made, via computer and/or operator, of which components to discard and which to collect.

Continuing with the embodiment of beam-induced fluorescence, the emitted light beam is then collected by the objective lens, and subsequently converted to an electronic signal by the optical sensor. The electronic signal is then digitized by an analog-digital converter (ADC) and sent to an electronic controller for signal processing. The electronic controller can be any electronic processer with adequate processing power, such as a DSP, a Micro Controller Unit (MCU), a Field Programmable Gate Array (FPGA), or even a Central Processing Unit (CPU). In one embodiment, the DSP-based controller monitors the electronic signal and may then trigger a sorting mechanism when a desired component is detected. In another embodiment, the FPGA-based controller monitors the electronic signal and then either communicates with the DSP controller or acts independently to trigger a sorting mechanism when a desired component is detected. In some other embodiments, the optical sensor may be a photomultiplier tube (PMT), an avalanche photodiode (APD), or a silicon photomultiplier (SiPM). In a preferred embodiment, the optical sensor may be an APD that detects the response of the sperm cell to interrogation.

In one embodiment of the sorting mechanism, the selected or desired components in the interrogation chamber are isolated into a desired output channel using a piezoelectric actuator. In an exemplary embodiment, the electronic signal activates the driver to trigger the actuator at the moment when the target or selected component arrives at a cross-section point of jet channels and the micro-channel. This causes the actuator to contact a diaphragm and push it, compressing a jet chamber, and squeezing a strong jet of buffer or sheath fluids into the micro-channel, which pushes the selected or desired component into a desired output channel.

In some embodiments, the isolated components are collected from their respective output channel (170) for storing, further separation, or processing, such as cryopreservation. In some embodiments, the outputted components may be characterized electronically, to detect concentrations of components, pH measuring, cell counts, electrolyte concentration, etc.

Chip Cassette and Holder

In some embodiments, the microfluidic chip may be loaded on a chip cassette, which is mounted on chip holder. The chip holder is mounted to a translation stage to allow fine positioning of the holder. For instance, the microfluidic chip holder is configured to hold the microfluidic chip in a pre-determined position such that the interrogating light beam intercepts the fluid components. In one embodiment, the microfluidic chip holder is made of a suitable material, such as aluminum alloy, or other suitable metallic/polymer material. A main body of the holder may be any suitable shape, but its configuration depends on the layout of the chip. In further embodiments, the main body of the holder is configured to receive and engage with external tubing for communicating fluids/samples to the microfluidic chip. A gasket of any desired shape, or O-rings, may be provided to maintain a tight seal between the microfluidic chip and the microfluidic chip holder. The gasket may be a single sheet or a plurality of components, in any configuration, or material (i.e., rubber, silicone, etc.) as desired. In one embodiment, the gasket interfaces, or is bonded (using an epoxy) with a layer of the microfluidic chip. The gasket is configured to assist in sealing, as well as stabilizing or balancing the microfluidic chip in the microfluidic chip holder. The details of the cassette and holder and the mechanisms for attachment of the chip to the cassette and holder, are not described in any detail, as one of ordinary skill in the art would know that these devices are well-known and may be of any configuration to accommodate the microfluidic chip, as long as the objectives of the present invention are met.

In some embodiments, a pumping mechanism includes a system having a pressurized gas which provides pressure for pumping sample fluid mixture from reservoir (i.e., sample tube) into sample input of the chip. In other embodiments, a collapsible container having sheath or buffer fluid therein, is disposed in a pressurized vessel, and the pressurized gas pushes fluid such that fluid is delivered via tubing to the sheath or buffer input of the chip.

In one embodiment, a pressure regulator regulates the pressure of gas within the reservoir, and another pressure regulator regulates the pressure of gas within the vessel. A mass flow regulator controls the fluid pumped via tubing, respectively, into the sheath or buffer input. Thus, tubing is used in the initial loading of the fluids into the chip, and may be used throughout the chip to load a sample fluid into sample input.

In accordance with the present invention, any of the operations, steps, control options, etc. may be implemented by instructions that are stored on a computer-readable medium such as a memory, database, etc. Upon execution of the instructions stored on the computer-readable medium, for example, by a computing device or processor, the instructions can cause the computing device or processor to perform any of the operations, steps, control options, etc. described herein. In some embodiments the operations described in this specification may be implemented as operations performed by a data processing apparatus or processing circuit on data stored on one or more computer-readable storage devices or received from other sources. A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A program can be stored in a portion of a file that holds other programs or data, in a single file dedicated to the program in question, or in multiple coordinated files. A program can be deployed to be executed on one computer or on multiple computers interconnected by a communication network. Processing circuits suitable for the execution of a computer program include, by way of example, both general and special purpose microprocessors, and any one or more processors of any kind of digital computer.

In one embodiment, a user interface of the computer system includes a computer screen which displays the components in a field of view acquired by a CCD camera over the microfluidic chip. In another embodiment, the computer controls any external devices such as pumps, if used, to pump any sample fluids, sheath or buffer fluids into the microfluidic chip, and also controls any heating devices which set the temperature of the fluids being inputted into the microfluidic chip.

It should be noted that the orientation of various elements may differ according to other illustrative embodiments, and that such variations are intended to be encompassed by the present disclosure. The construction and arrangements of the microfluidic chip, as shown in the various illustrative embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various illustrative embodiments without departing from the scope of the present disclosure.

As used herein, the term "about" refers to plus or minus 10% of the referenced number.

Although there has been shown and described the preferred embodiment of the present invention, it will be readily apparent to those skilled in the art that modifications may be made thereto which do not exceed the scope of the appended claims.

Therefore, the scope of the invention is only to be limited by the following claims. Reference numbers recited in the below claims are exemplary and solely for ease of examination of this patent application, and are not intended in any way to limit the scope of the claims to the particular features having the corresponding reference numbers in the drawings. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting essentially of" or "consisting of", and as such the written description requirement for claiming one or more embodiments of the present invention using the phrase "consisting essentially of" or "consisting of" is met.

What is claimed is:

1. A microfluidic chip (100) for flowing a sample fluid mixture comprising sperm cells therethrough as a fluid stream, and for uniformly orienting and positioning the sperm cells flowed therethrough for interrogation and selective action, the microfluidic chip comprising:

a. an intersection region (145) for introducing sheath fluid into the microfluidic chip (100);

b. a micro-channel (120) disposed downstream of the intersection region (145), wherein the micro-channel (120) comprises a first straight portion, a constricting portion (122) downstream of the first straight portion, and a second straight portion downstream of the constricting portion (122), wherein the constricting portion (122) narrows in width only, wherein the constricting portion (122) only geometrically compresses the sample fluid mixture, wherein the second straight portion is narrower in width than the first straight portion, wherein the micro-channel (120) is configured to provide laminar flow;

c. a flow focusing region (130) downstream of the constricting portion (122) and the second straight portion of the micro-channel (120), the flow focusing region (130) comprising a positively sloping bottom surface (132) that reduces a height of the flow focusing region and sidewalls (135) that taper to reduce a width of the flow focusing region, thereby geometrically constricting the flow focusing region (130); and d. the sample fluid mixture comprising the sperm cells, wherein the sample fluid mixture flows through the sample micro-channel (110), the intersection region (145), the micro-channel (120), and the flow focusing region (130), wherein the first straight portion, the constricting portion (122), the second straight portion, and the focusing region (130) are downstream of the intersection region (145).

2. The microfluidic chip (100) of claim 1, wherein the constricting portion (122) of the micro-channel comprises sidewalls (125) that taper.

3. The microfluidic chip (100) of claim 1, wherein the positively sloping bottom surface (132) and tapering sidewalls (135) occur simultaneously from an upstream end (137) to a downstream end (138) of the flow focusing region.

4. The microfluidic chip (100) of claim 1, wherein the positively sloping bottom surface (132) and tapering sidewalls (135) begin from a plane that perpendicularly traverses the flow focusing region (130).

5. A microfluidic chip (100) for flowing a sample fluid mixture comprising sperm cells therethrough as a fluid stream, and for uniformly orienting and positioning the sperm cells flowed therethrough for interrogation and selective action, the microfluidic chip comprising:

a. a sample micro-channel (110);

b. two sheath fluid micro-channels (140);

c. a first focusing region that includes an intersection region (145) formed by the two sheath fluid micro-channels (140) intersecting the sample micro-channel (110), wherein sheath fluid is introduced into the intersection region (145) by the two sheath fluid micro-channels (140), wherein the first focusing region combines geometric compression with the sheath fluid introduction;

d. a downstream micro-channel (120) fluidly connected to and downstream of the intersection region (145), the downstream micro-channel (120) having a first straight portion, a constricting portion (122) downstream of the first straight portion, and a second straight portion downstream of the constricting portion (122), wherein the constricting portion (122) narrows in width only, wherein the constricting portion (122) only geometrically compresses the sample fluid mixture, wherein the second straight portion is narrower in width than the first straight portion, wherein the micro-channel (120) is configured to provide laminar flow;

e. a second flow focusing region (130) fluidly connected to the downstream micro-channel (120) and downstream of the constricting portion (122) and the second straight portion, the second flow focusing region (130) comprising a positively sloping bottom surface (132) that reduces a height of the flow focusing region and sidewalls (135) that taper to reduce a width of the second flow focusing region, thereby geometrically constricting the second flow focusing region (130); and f. the sample fluid mixture comprising the sperm cells;

wherein the first straight portion, the constricting portion (122), the second straight portion, and the second flow focusing region (130) are downstream of the intersection region (145), wherein the sample micro-channel (110) is configured to flow the sample fluid mixture, wherein the two sheath fluid micro-channels (140) are each configured to flow the sheath fluid into the intersection region (145) to cause laminar flow and to compress the sample fluid mixture flowing from the sample micro-channel (110) at least horizontally from at least two sides such that the sample fluid mixture becomes surrounded by sheath fluid and compressed into a thin stream.

6. The microfluidic chip (100) of claim 5, wherein the sample micro-channel (110) includes a narrowing region (112) downstream of an inlet (111) of the sample micro-channel, wherein the narrowing region (112) comprises:

a. a positively sloping bottom surface (114) that reduces a height of the narrowing region; and b. sidewalls (115) that taper to reduce a width of the narrowing region, wherein the positively sloping bottom surface (114) and tapering sidewalls (115) geometrically constrict the narrowing region (112).

7. The microfluidic chip (100) of claim 5, wherein an outlet (113) of the sample micro-channel is positioned at or near mid-height of an outlet (143) of each of the two sheath fluid micro-channels, wherein an inlet (124) of the downstream micro-channel is positioned at or near mid-height of the outlet (143) of each of the two sheath fluid micro-channels.

8. The microfluidic chip (100) of claim 7, wherein the outlet (113) of the sample micro-channel and the inlet (124) of the downstream micro-channel are aligned.

9. The microfluidic chip (100) of claim 5, wherein an outlet (113) of the sample micro-channel is positioned at or near mid-height of the intersection region.

10. The microfluidic chip (100) of claim 5, wherein an inlet (124) of the downstream micro-channel is positioned at or near mid-height of the intersection region.

11. The microfluidic chip (100) of claim 5, wherein the intersection region (145) and the second flow focusing region (130) are configured to focus the sperm cells in the sample fluid mixture.

12. The microfluidic chip (100) of claim 5, wherein compression of the sample fluid mixture centralizes the sperm cells within the sample fluid mixture such that the sperm cells are focused at or near a center of the downstream micro-channel.

13. The microfluidic chip (100) of claim 5 further comprising an interrogation region (150) downstream of the second flow focusing region (130).

14. The microfluidic chip (100) of claim 13 further comprising an expansion region (160) downstream of the interrogation region (150), comprising:

a. a negatively sloping bottom surface (162) that increases a height of the expansion region; and b. an expansion portion having sidewalls (165) that widen to increase a width of the expansion region.

15. The microfluidic chip (100) of claim 14 further comprising a plurality of output micro-channels (170) downstream of and fluidly coupled to the expansion region (160).

16. A method of focusing particles in a fluid flow, comprising:

a) providing a microfluidic chip (100) comprising:

i. a sample micro-channel (110);

ii. two sheath fluid micro-channels (140);

iii. a first focusing region that includes an intersection region (145) formed by the two sheath fluid micro-channels (140) intersecting the sample micro-channel (110), wherein the first focusing region combines geometric compression with sheath fluid introduction;

iv. a downstream micro-channel (120) fluidly connected to and downstream of the intersection region (135), the downstream micro-channel (120) having a first straight portion, a constricting portion (122) downstream of the first straight portion, and a second straight portion downstream of the constricting portion (122), wherein the constricting portion (122) narrows in width only, wherein the constricting portion (122) only geometrically compresses the sample fluid mixture, wherein the second straight portion is narrower in width than the first straight portion, wherein the micro-channel (120) is configured to provide laminar flow; and v. a second flow focusing region (130) fluidly connected to the downstream micro-channel (120) and downstream of the constricting portion (122) and the second straight portion, the second flow focusing region (130) comprising a positively sloping bottom surface (132) that reduces a height of the flow focusing region and sidewalls (135) that taper to reduce a width of the second flow focusing region, thereby geometrically constricting the second flow focusing region (130), wherein the first straight portion, the constricting portion (122), the second straight portion, and the second flow focusing region (130) are downstream of the intersection region (145);

b) flowing a fluid mixture comprising the particles into the sample micro-channel (110) and into the intersection region (145);

c) flowing a sheath fluid through the two sheath fluid micro-channels (140) and into the intersection region (145) such that the sheath fluid causes laminar flow and compresses the fluid mixture at least horizontally from at least two sides, wherein the fluid mixture becomes surrounded by sheath fluid and compressed into a thin stream, wherein the particles are constricted into the thin stream surrounded by the sheath fluid;

d) flowing the fluid mixture and sheath fluids into the downstream micro-channel (120), wherein the constricting portion (122) of the downstream micro-channel (120) horizontally compresses the thin stream of fluid mixture; and e) flowing the fluid mixture and sheath fluids into the second flow focusing region (130), wherein the positively sloping bottom surface (132) and tapering sidewalls (135) further constrict the fluid mixture stream and re-orient the particles within the stream, thereby focusing the particles.

17. A method of producing a fluid with gender-skewed sperm cells, said method comprising:

a) providing a microfluidic chip (100) comprising:

i. a sample micro-channel (110);

ii. two sheath fluid micro-channels (140);

iii. a first focusing region that includes an intersection region (145) formed by the two sheath fluid micro-channels (140) intersecting the sample micro-channel (110), wherein the first focusing region combines geometric compression with sheath fluid introduction;

iv. a downstream micro-channel (120) fluidly connected to and downstream of the intersection region (135), the downstream micro-channel (120) having a first straight portion, a constricting portion (122) downstream of the first straight portion, and a second straight portion downstream of the constricting portion (122), wherein the constricting portion (122) narrows in width only, wherein the constricting portion (122) only geometrically compresses the sample fluid mixture, wherein the second straight portion is narrower in width than the first straight portion, wherein the micro-channel (120) is configured to provide laminar flow; and v. a second flow focusing region (130) fluidly connected to the downstream micro-channel (120) and downstream of the constricting portion (122) and the second straight portion, the second flow focusing region (130) comprising a positively sloping bottom surface (132) that reduces a height of the flow focusing region and sidewalls (135) that taper to reduce a width of the second flow focusing region, thereby geometrically constricting the second flow focusing region (130), wherein the first straight portion, the constricting portion (122), the second straight portion, and the second flow focusing region (130) are downstream of the intersection region (145);

b) flowing a semen fluid comprising sperm cells into the sample micro-channel (110) and into the intersection region (145);

c) flowing a sheath fluid through the two sheath fluid micro-channels (140) and into the intersection region (145) such that the sheath fluid causes laminar flow and compresses the semen fluid at least horizontally from at least two sides, wherein the semen fluid becomes surrounded by sheath fluid and compressed into a thin stream;

d) flowing the semen fluid and sheath fluids into the downstream micro-channel (120), wherein the constricting portion (122) of the downstream micro-channel (120) horizontally compresses the thin stream of semen fluid;

e) flowing the semen fluid and sheath fluids into the second flow focusing region (130), wherein the positively sloping bottom surface (132) and tapering sidewalls (135) further constrict the semen fluid stream to focus the sperm cells at or near a center the semen fluid stream;

f) determining a chromosome type of the sperm cells in the semen fluid stream, wherein each sperm cell is either a Y-chromosome-bearing sperm cell or an X-chromosome-bearing sperm cell; and g) sorting Y-chromosome-bearing sperm cells from X-chromosome-bearing sperm cells, thereby producing the fluid comprising gender-skewed sperm cells that are predominantly Y-chromosome-bearing sperm cells.

18. The method of claim 17, wherein the microfluidic chip (100) further comprises an interrogation region (150) downstream of the second flow focusing region (130), wherein an interrogation apparatus, coupled to the interrogation region (150), is used to determine the chromosome type of the sperm cells and sort said sperm cells based on chromosome type.

19. The method of claim 18, wherein the interrogation apparatus comprises a radiation source that illuminates and excites the sperm cells, wherein a response of the sperm cell is indicative of the chromosome type in the sperm cell, wherein the response of the sperm cell is detected by an optical sensor.

20. The method of claim 19, wherein the interrogation apparatus further comprises a laser source, wherein Y-chromosome-bearing sperm cells are sorted from the X-chromosome-bearing sperm cells by laser ablation, wherein the X-chromosome-bearing sperm cells are exposed to the laser source that damages or kills said cells.

* * * * *